US011867198B2

(12) United States Patent
Lee et al.

(10) Patent No.: US 11,867,198 B2
(45) Date of Patent: Jan. 9, 2024

(54) BLOWER

(71) Applicant: LG ELECTRONICS INC., Seoul (KR)

(72) Inventors: Kunyoung Lee, Seoul (KR); Jaehun Kim, Seoul (KR); Bohyun Kim, Seoul (KR); Myungjin Ku, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 0 days.

(21) Appl. No.: 17/898,798

(22) Filed: Aug. 30, 2022

(65) Prior Publication Data

US 2023/0068192 A1 Mar. 2, 2023

(30) Foreign Application Priority Data

Aug. 31, 2021 (KR) ..... 10-2021-0115778
Jun. 14, 2022 (KR) ..... 10-2022-0072275

(51) Int. Cl.
*F04D 29/52* (2006.01)
*F24F 8/22* (2021.01)
(Continued)

(52) U.S. Cl.
CPC ..... *F04D 29/522* (2013.01); *F04D 19/002* (2013.01); *F04D 29/644* (2013.01);
(Continued)

(58) Field of Classification Search
CPC .... F04D 19/002; F04D 29/522; F04D 29/644; F04D 29/701; F04D 29/703;
(Continued)

(56) References Cited

U.S. PATENT DOCUMENTS 2,628,083 A * 2/1953 Rense ..... F24F 3/12 55/467
3,576,593 A * 4/1971 Cicirello ..... F24F 8/22 250/493.1
(Continued)

FOREIGN PATENT DOCUMENTS

CN 109185995 1/2019
EP 3009760 A1 * 4/2016 ..... F24F 13/20
(Continued)

OTHER PUBLICATIONS

European Search Report dated Jan. 26, 2023 issued in Application No. 22192986.2.

*Primary Examiner* — John M Zaleskas
(74) *Attorney, Agent, or Firm* — KED & ASSOCIATES, LLP

(57) ABSTRACT

A blower includes: a fan configured to generate a flow of air; a filter positioned upstream of the fan; a case covering a side surface of the filter and having a suction hole; a housing which is positioned opposite to the fan with respect to the filter, and to which the case is detachably coupled; a supporter coupled to one surface of the housing facing the filter and configured to support the filter; a light source disposed at the supporter and configured to provide light in an ultraviolet wavelength band to the fan; and a controller configured to control an operation of the light source, wherein the controller stops the operation of the light source when the case is separated from the housing or when the filter is separated from the supporter.

20 Claims, 25 Drawing Sheets

(51) Int. Cl.

| | |
|---|---|
| ***F04D 19/00*** | (2006.01) |
| ***F04D 29/64*** | (2006.01) |
| ***F04D 29/70*** | (2006.01) |
| ***F24F 8/108*** | (2021.01) |
| ***F24F 13/20*** | (2006.01) |
| ***F24F 11/32*** | (2018.01) |
| ***F24F 1/0328*** | (2019.01) |

(52) U.S. Cl.
CPC ..... *F04D 29/703* (2013.01); *F24F 1/0328* (2019.02); *F24F 8/108* (2021.01); *F24F 8/22* (2021.01); *F24F 11/32* (2018.01); *F24F 13/20* (2013.01)

(58) Field of Classification Search
CPC .. F24F 1/0328; F24F 1/035; F24F 8/22; F24F 11/32; F24F 13/20; F24F 8/108; F24F 13/28; A61L 9/20; A61L 2209/14
See application file for complete search history.

(56) References Cited

U.S. PATENT DOCUMENTS 4,210,429 A * 7/1980 Golstein ..... F24F 8/158 55/473
5,399,319 A * 3/1995 Schoenberger .... B01D 46/0028 55/385.2
5,505,904 A * 4/1996 Haidinger ..... A61L 9/20 422/4
6,053,968 A * 4/2000 Miller ..... F24F 8/22 96/16
6,464,760 B1 * 10/2002 Sham ..... B01D 53/0415 55/318
6,494,940 B1 * 12/2002 Hak ..... B01D 46/10 96/417
6,818,177 B1 * 11/2004 Turcotte ..... F24F 8/192 250/435
6,939,397 B2 9/2005 Nelsen et al.
2003/0121419 A1 * 7/2003 Gibson ..... A61L 9/20 96/224
2003/0206837 A1 * 11/2003 Taylor ..... B01D 53/32 422/186
2003/0206839 A1 * 11/2003 Taylor ..... A61L 9/22 422/186.04
2003/0206840 A1 * 11/2003 Taylor ..... A61L 9/015 422/186.04
2003/0209420 A1 * 11/2003 Taylor ..... C01B 13/115 422/186.04
2004/0211321 A1 * 10/2004 Gibson ..... A61L 9/20 96/381
2004/0251124 A1 * 12/2004 Lau ..... B03C 3/68 422/186.04
2004/0251909 A1 * 12/2004 Taylor ..... A61L 9/22 324/509
2005/0000365 A1 * 1/2005 Nelsen ..... F24F 8/80 96/224
2005/0158219 A1 * 7/2005 Taylor ..... A61L 9/20 422/121
2005/0183576 A1 * 8/2005 Taylor ..... B03C 3/365 96/60
2005/0189210 A1 * 9/2005 Uslenghi ..... A61L 9/20 422/186.3
2005/0238551 A1 * 10/2005 Snyder ..... A61L 9/205 422/186.3
2009/0064864 A1 * 3/2009 Mann ..... B01D 46/88 96/223
2012/0085927 A1 * 4/2012 Maeng ..... F24F 1/005 250/454.11
2017/0122583 A1 * 5/2017 Lee ..... F24F 13/20
2019/0170157 A1 * 6/2019 Mogridge ..... F04D 25/08
2020/0298162 A1 * 9/2020 Jeon ..... A47L 7/04
2020/0298168 A1 * 9/2020 Lee ..... B01D 46/46
2021/0277911 A1 * 9/2021 Jung ..... F04D 29/403
2021/0277913 A1 * 9/2021 Kim ..... F04D 29/26
2021/0372437 A1 * 12/2021 Jung ..... F04D 29/441
2022/0125986 A1 * 4/2022 Shalvi ..... B01D 46/444
2022/0126750 A1 * 4/2022 Vorac ..... B60R 7/04
2022/0184543 A1 * 6/2022 Choi ..... F24F 8/20
2023/0003232 A1 * 1/2023 Kim ..... F04D 29/403
2023/0071587 A1 * 3/2023 Lee ..... F04D 29/524
2023/0102734 A1 * 3/2023 Kim ..... F04F 5/16 415/148

FOREIGN PATENT DOCUMENTS

JP 2004357775 A * 12/2004
KR 20160045337 A * 4/2016
KR 20160045493 A * 4/2016
KR 10-1634528 6/2016
KR 20200056092 A * 11/2018
KR 20200011814 A * 2/2020
KR 20200112591 A * 10/2020
KR 20200127456 A * 11/2020
KR 10-2211993 2/2021

* cited by examiner

BLOWER

CROSS-REFERENCE TO RELATED APPLICATIONS

This application claims the benefit of earlier filing date and right of priority of Korean Patent Application No. 10-2021-0115778, filed in Korea on Aug. 31, 2021, and Korean Patent Application No. 10-2022-0072275, filed in Korea on Jun. 14, 2022, the contents of which are incorporated herein by reference in their entirety.

BACKGROUND

1. Field

The present disclosure relates to a blower. More particularly, the present disclosure relates to a blower capable of sterilizing a fan.

2. Background

A blower may cause a flow of air to circulate air in an indoor space, or to form an airflow toward a user. In addition, a filter provided in the blower can purify indoor air.

However, a fan provided in a conventional blower has a problem in that bacteria or microorganisms accumulates over time, thereby deteriorating the air purification performance by the filter. In addition, the conventional blower was inconvenient in that a user have to directly remove bacteria, etc. accumulated in the fan.

In recent years, many studies have been made on a structure or method capable of maintaining the air purification performance of a blower for a long time.

BRIEF DESCRIPTION OF THE DRAWINGS

Embodiments will be described in detail with reference to the following drawings in which like reference numerals refer to like elements, and wherein:

FIG. 7 is a top view of the blower, and FIG. 8 is a perspective view of the blower in which a dotted arrow expresses the diffusion airflow;

FIG. 9 is a top view of the blower, and FIG. 10 is a perspective view of the blower in which a dotted arrow expresses the upward airflow;

DETAILED DESCRIPTION

Figure 1:
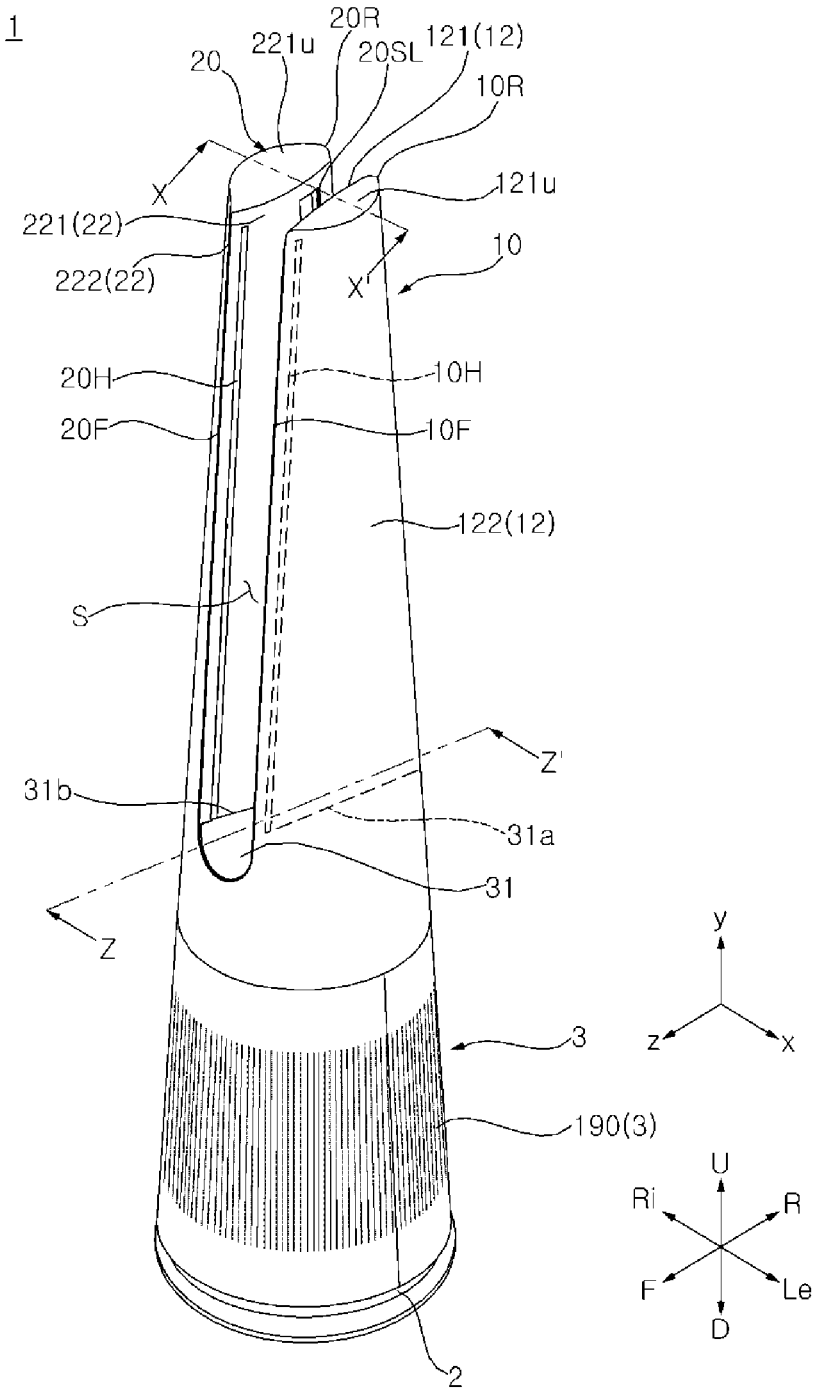
FIG. 1 is a perspective view of a blower according to an embodiment of the present disclosure.

Hereinafter, embodiments disclosed in the present specification will be described in detail with reference to the accompanying drawings, but the same or similar components are assigned the same reference numerals regardless of reference numerals, and redundant description thereof will be omitted.

In the present disclosure, that which is well known to one of ordinary skill in the relevant art has generally been omitted for the sake of brevity. The accompanying drawings are used to assist in easy understanding of various technical features and it should be understood that the embodiments presented herein are not limited by the accompanying drawings. As such, the present disclosure should be construed to extend to any alterations, equivalents and substitutes in addition to those which are particularly set out in the accompanying drawings.

It will be understood that although the terms first, second, etc. may be used herein to describe various elements, these elements should not be limited by these terms. These terms are only used to distinguish one element from another The direction indications of up (U), down (D), left (Le), right (Ri), front (F), and rear (R) shown in the drawings are only for convenience of description, and the technical concept disclosed in the present specification is not limited thereto.

Referring to FIG. 1, a blower 1 may extend long in the up-down direction. The blower 1 may be referred to as an air conditioner or an air cleaner. The blower 1 may include a base 2, a lower body 3, and an upper body 10, 20.

The base 2 forms a lower surface of the blower 1 and may be placed on the floor of an indoor space. The base 2 may be formed in a circular plate shape as a whole.

The lower body 3 may be disposed in the upper side of the base 2. The lower body 3 may form the lower portion of side surface of the blower 1. The lower body 3 may be formed in a cylindrical shape as a whole. For example, the diameter of the lower body 3 may decrease as it progresses from the lower portion of the lower body 3 to the upper portion. As another example, the diameter of the lower body 3 may be uniformly maintained in the up-down direction. A suction hole 3*a* may be formed through the side surface of the lower body 3. For example, the plurality of suction holes 3*a* may be evenly disposed along the circumferential direction of the lower body 3. Accordingly, air may flow in from the outside of the blower 1 to the inside through the plurality of suction holes 3*a*.

The upper body 10, 20 may be disposed in the upper side of the lower body 3. The upper body 10, 20 may provide a flow path communicating with the inner space of the lower body 3.

Referring to the drawing, for example, the upper body 10, 20 may include a first upper body 10 and a second upper body 20 spaced apart from each other.

As another example, the upper body 10, 20 may be provided as a single upper body. In this case, the upper body 10, 20 may extend long in the up-down direction at the upper side of the lower body 3, or may be formed in the shape of a ring having the form of a circle (ellipse) or track or in the shape of an open ring. The position of the single upper body 10, 20 with respect to the lower body 3 may be determined in consideration of the shape of the upper body 10, 20 and the position, shape, and number of slits, as an air discharge hole formed in the upper body 10, 20, formed on the surface of the upper body 10, 20.

Hereinafter, for a brief description, a case in which the upper body 10 and 20 includes the first upper body 10 and the second upper body 20 will be described. In addition, the description may be identically applicable even when the upper body 10 and 20 is provided as a single upper body, unless the description is applicable only to a case where the number of the upper body 10, 20 is two.

The first upper body 10 and the second upper body 20 may be disposed in the upper side of the lower body 3. The first upper body 10 and the second upper body 20 may form upper side surfaces of the blower 1. The first upper body 10 and the second upper body 20 may extend long in the up-down direction, and may be spaced apart from each other in the left-right direction. Meanwhile, the first upper body 10 may be referred to as a first tower or a first nozzle tower, and the second upper body 20 may be referred to as a second tower or a second nozzle tower.

A space S may be formed between the first upper body 10 and the second upper body 20, and may provide an air flow path. The space S may be opened in the front-rear direction. Meanwhile, the space S may be referred to as a blowing space, a valley, or a channel.

The first upper body 10 may be spaced apart from the second upper body 20 to the left. The first upper body 10 may extend long in the up-down direction. The first upper body 10 may include a first panel 12 forming a surface of the first upper body 10. The first panel 12 may include a first inner panel 121 facing the space S and a first outer panel 122 facing the first inner panel 121.

The first inner panel 121 may be convex in a direction from the first upper body 10 toward the space S, i.e., to the right. For example, the first inner panel 121 may extend long in the up-down direction. The first outer panel 122 may be convex in a direction opposite to the direction from the first upper body 10 toward the space S, i.e., to the left. For example, the first outer panel 122 may extend to be inclined by a certain angle (acute angle) in a direction toward the space S, that is, to the right with respect to a vertical line extending in the up-down direction.

In this case, the curvature of the first outer panel 122 may be greater than the curvature of the first inner panel 121. In addition, the first outer panel 122 may meet the first inner panel 121 to form an edge. The edge may be provided as a first front end 10F and a first rear end 10R of the first upper body 10. For example, the first front end 10F may extend to be inclined in the rearward direction by a certain angle (acute angle) with respect to a vertical line extending in the up-down direction. For example, the first rear end 10R may extend to be inclined in the forward direction by a certain angle (acute angle) with respect to a vertical line extending in the up-down direction.

The second upper body 20 may be spaced apart from the first upper body 10 to the right. The second upper body 20 may extend long in the up-down direction. The second upper body 20 may include a second panel 22 forming a surface of the second upper body 20. The second panel 22 may include a second inner panel 221 facing the space S, and a second outer panel 222 facing the second inner panel 221.

The second inner panel 221 may be convex in a direction from the second upper body 20 toward the space S, i.e., to the left. For example, the second inner panel 221 may extend long in the up-down direction. The second outer panel 222 may be convex in a direction from the second upper body 20 toward the space S, i.e., to the right. For example, the second outer panel 222 may extend to be inclined by a certain angle (acute angle) in a direction toward the space S with respect to a vertical line extending in the up-down direction, i.e., to the left.

In this case, the curvature of the second outer panel 222 may be greater than the curvature of the second inner panel 221. In addition, the second outer panel 222 may meet the first inner panel 221 to form an edge. The edge may be provided as a second front end 20F and a second rear end 20R of the second upper body 20. For example, the second front end 20F may extend in the rearward direction by a certain angle (acute angle) with respect to a vertical line extending in the up-down direction. For example, the second rear end 20R may extend in the forward direction by a certain angle (acute angle) with respect to a vertical line extending in the up-down direction.

Meanwhile, the first upper body 10 and the second upper body 20 may be symmetrical left and right with the space S interposed therebetween. In addition, the surface of the first outer panel 122 and the surface of the second outer panel 222 may be located on a virtual curved surface extending along the surface of the lower body 3. In other words, the surface of the first outer panel 122 and the surface of the second outer panel 222 may be smoothly connected to the surface of the lower body 3. In addition, the upper surface 121*u* of the first upper body 10 and the upper surface 221*u* of the second upper body 20 may be provided in a horizontal plane. In this case, the blower 1 may be formed in a truncated cone shape as a whole. Thus, the risk of the blower 1 being overturned by an external impact can be lowered.

A groove 31 may be located between the first upper body 10 and the second upper body 20, and may extend long in the front-rear direction. The groove 31 may be a curved surface concave downward. The groove 31 may include a first side 31*a* connected to a lower side of the first inner panel 121 and a second side 31*b* connected to a lower side of the second inner panel 221. The groove 31 may define a boundary of the space S together with the first inner panel 121 and the second inner panel 221. Meanwhile, the groove 31 may be referred to as a connection groove or a connection surface.

Figure 2:
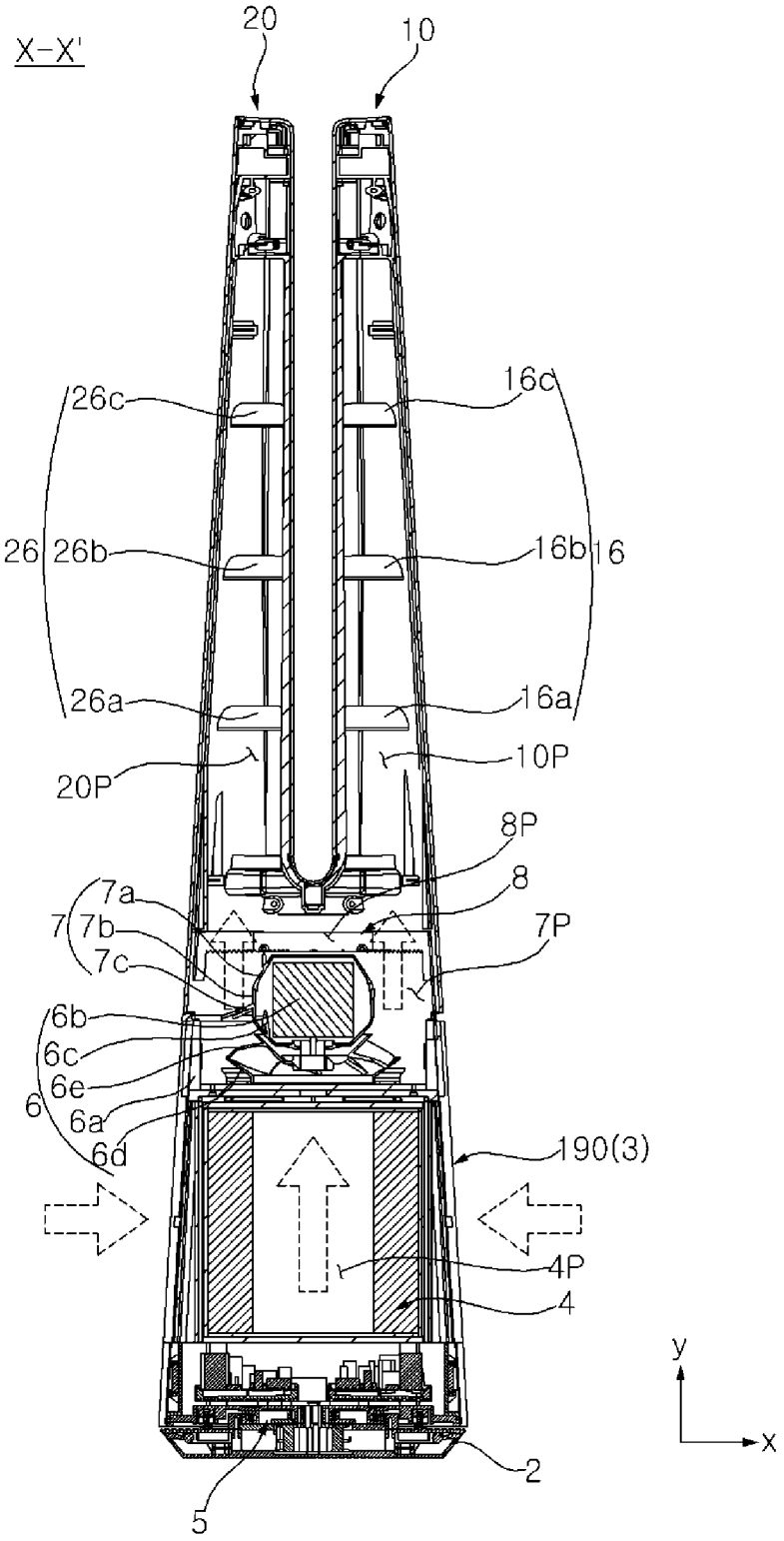
FIG. 2 is a cross-sectional view taken along line X-X' of FIG. 1.

Referring to FIG. 2, the lower body 3 may provide an internal space in which a filter 4, a controller 5, a fan 6, and an air guide 7 described later are installed.

The filter 4 may be detachably installed in the inner space of the lower body 3. The filter 4 may be formed in a cylindrical shape as a whole. That is, the filter 4 may include a hole 4P formed through the filter 4 in the up-down direction. The filter 4 may include a ring-shaped lower frame 4*a* forming the lower end of the filter 4 and a ring-shaped upper frame 4*b* forming the upper end of the filter 4 (refer to FIG. 13). The indoor air may flow into the inside of the lower body 3 through the suction hole 3*a* (refer to FIG. 1) by the operation of the fan 6. In addition, the indoor air flowed into the inside of the lower body 3 may flow from the outer circumferential surface of the filter 4 to the inner circumferential surface and be purified, and may flow to the upper side of the filter 4 through the hole 4P.

The controller 5 may be installed in the inner space of the lower body 3. The controller 5 may be electrically connected to each component of the blower 1, and may control the operation of the blower 1.

The fan 6 may be installed in the inner space of the lower body 3, and disposed in the upper side of the filter 4. The fan 6 may flow into the inside of the blower 1 to cause a flow of air discharged to the outside of the blower 1. The fan 6 may include a fan housing 6*a*, a fan motor 6*b*, a hub 6*c*, a shroud 6*d*, and a blade 6*e*. Meanwhile, the fan 6 may be referred to as a fan assembly or a fan module.

The fan housing 6*a* may form an outer shape of the fan 6. The fan housing 6*a* may have a cylindrical shape as a whole. A bell mouth 6*f* may be located in the lower end of the fan housing 6*a*. A suction port (unsigned) may be formed in the inner side of the bell mouth 6*f*, and may provide air to the shroud 6*d* described later.

The fan motor 6*b* may provide rotational force. The fan motor 6*b* may be a centrifugal fan or a mixed flow fan motor. The fan motor 6*b* may be supported by a motor cover 7*b* described later. In this case, the rotation shaft of the fan motor 6*b* may extend from the fan motor 6*b* to the lower side of the fan motor 6*b*, and may penetrate the lower surface of the motor cover 7*b*. The hub 6*c* may be fixed to the rotation shaft and rotate together with the rotation shaft. The shroud 6*d* may be spaced from the hub 6*c* to the outer side of the hub 6*c*. A plurality of blades 6*e* may be disposed between the hub 6*c* and the shroud 6*d*.

Accordingly, when the fan motor 6*b* is driven, air may flow in the axial direction of the fan motor 6*b* through the suction port, and may be discharged in the radial direction of the fan motor 6*b* and to the upper side thereof.

The air guide 7 may be disposed in the upper side of the fan 6, i.e., downstream of the fan 6, and may provide a flow path 7P through which air discharged from the fan 6 flows. For example, the flow path 7P may be an annular flow path. The air guide 7 may include a guide body 7*a*, a motor cover 7*b*, and a vane 7*c*. Meanwhile, the air guide 7 may be referred to as a diffuser.

The guide body 7*a* may form the outer shape of the air guide 7. The motor cover 7*b* may be disposed in the central portion of the air guide 7. For example, the guide body 7*a* may be formed in a cylindrical shape. In addition, the motor cover 7*b* may be formed in a bowl shape. In this case, the aforementioned annular flow path 7P may be formed between the guide body 7*a* and the motor cover 7*b*. The plurality of vanes 7*c* may be disposed in the annular flow path 7P, and may be spaced apart from each other in the circumferential direction of the guide body 7*a*. Each of the plurality of vanes 7*c* may extend from the outer surface of the motor cover 7*b* to the inner circumferential surface of the guide body 7*a*. Accordingly, the plurality of vanes 7*c* may guide the air provided from the fan 6 to the flow path 7P to the upper side of the air guide 7.

A distribution unit 8 may be disposed between the air guide 7 and the upper body 10, 20. The distribution unit 8 may provide a flow path 8P through which the air passing through the air guide 7 flows. The air passing through the air guide 7 may be distributed to the first upper body 10 and the second upper body 20 through the distribution unit 8. Meanwhile, the distribution unit 8 may be referred to as a splitter, a middle body, an inner body, a tower base, or a nozzle tower base.

The first upper body 10 may provide a first flow path 10P through which a portion of the air that has passed through the air guide 7 and the distribution unit 8 flows. The first flow path 10P may be formed in the inner space of the first upper body 10. The second upper body 20 may provide a second flow path 20P through which the remainder of the air that has passed through the air guide 7 and the distribution unit 8 flows. The second flow path 20P may be formed in the inner space of the second upper body 20. That is, the first flow path 10P and the second flow path 20P may communicate with the flow path 8P of the distribution unit 8 and the flow path 7P of the air guide 7.

Figure 3:
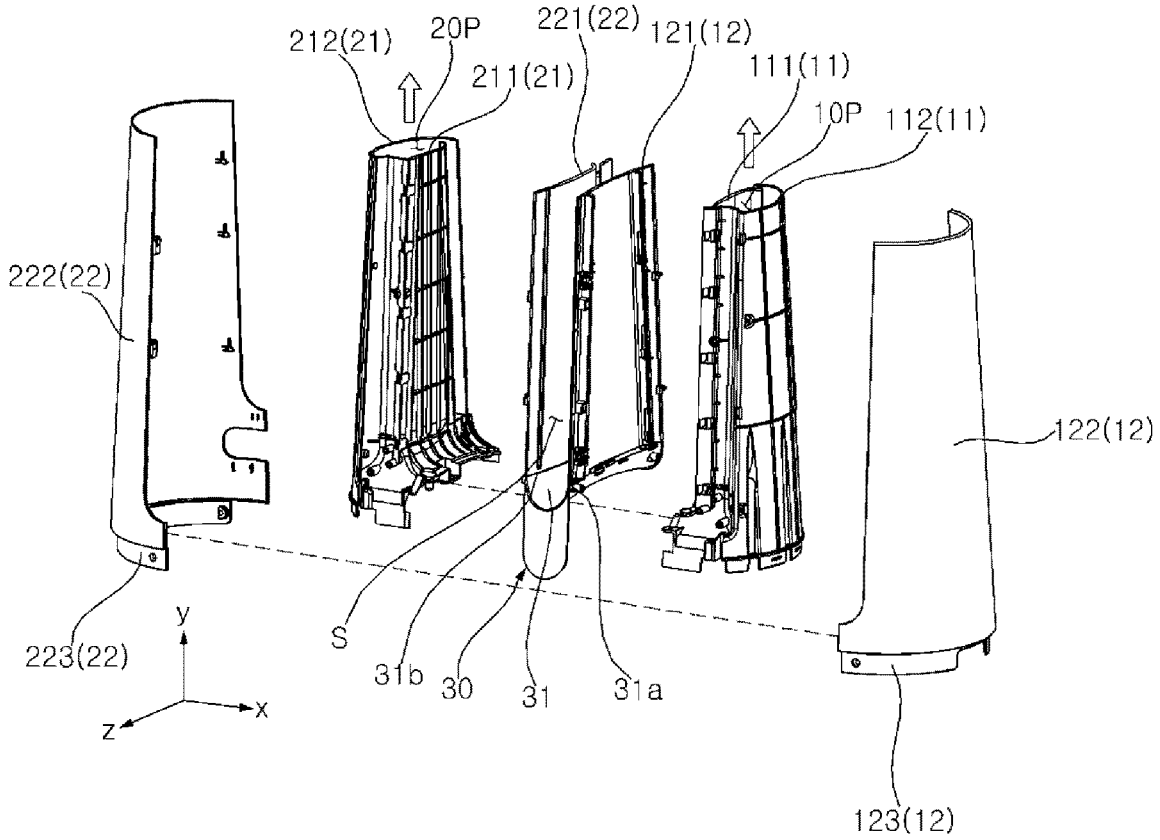
FIG. 3 is an exploded perspective view of a first upper body and a second upper body of a blower according to an embodiment of the present disclosure.

Referring to FIGS. 1 and 3, the first upper body 10 may include a first wall 11, in addition to the first inner panel 121 and the first outer panel 122 described above. The first wall 11 may be located between the first inner panel 121 and the first outer panel 122. That is, the first panel 12 may surround the first wall 11. The first wall 11 may include a first inner wall 111 facing the inner side of the first inner panel 121 and a first outer wall 112 facing the inner side of the first outer panel 122.

The first inner wall 111 may be detachably coupled to the inner side of the first inner panel 121. The first outer wall 112 may be detachably coupled to the inner side of the first outer panel 122. The first inner wall 111 and the first outer wall 112 may be coupled to each other, and form a first flow path 10P. In addition, the first inner panel 121 may be coupled to or fixed to a groove body 30 having the groove 31.

Accordingly, the first panel 12 may form a surface of the first upper body 10, and the first wall 11 may provide a first flow path 10P through which air flows.

The second upper body 20 may include a second wall 21, in addition to the second inner panel 221 and the second outer panel 222 described above. The second wall 21 may be located between the second inner panel 221 and the second outer panel 222. That is, the second panel 22 may surround the second wall 21. The second wall 21 may include a second inner wall 211 facing the inner side of the second inner panel 221 and a second outer wall 212 facing the inner side of the second outer panel 222.

The second inner wall 211 may be detachably coupled to the inner side of the second inner panel 221. The second outer wall 212 may be detachably coupled to the inner side of the second outer panel 222. The second inner wall 211 and the second outer wall 212 may be coupled to each other, and form a second flow path 20P. In addition, the second inner panel 221 may be coupled to or fixed to the groove body 30 having the groove 31.

Accordingly, the second panel 22 may form a surface of the second upper body 20, and the second wall 21 may provide a second flow path 20P through which air flows.

Figure 4:
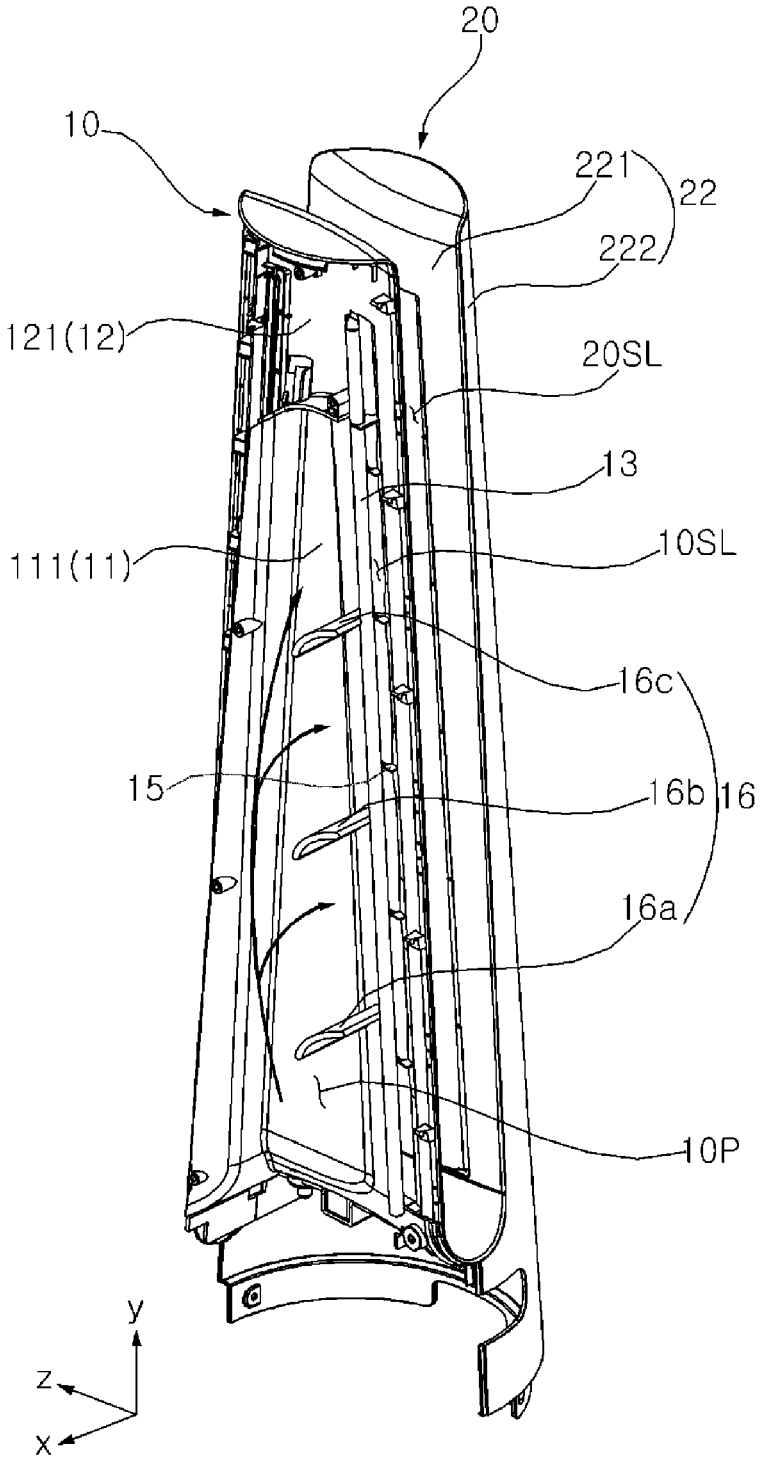
FIG. 4 is a perspective view illustrating a state in which a first outer panel is separated from a first upper body of a blower according to an embodiment of the present disclosure.

Referring to FIG. 4, a first vane 16 may be installed in the first flow path 10P. The first vane 16 may be coupled to the inner side of the first wall 11. For example, the first vane 16 may be located between the first inner wall 111 and the first outer wall 112 (refer to FIG. 3), and the right end of the first vane 16 may be coupled or fixed to the inner surface of the first inner wall 111.

The first vane 16 may be adjacent to a first slit 10SL of the first upper body 10 described later. The first vane 16 may have a convex shape. The rear end of the first vane 16 may be located in the upper side of the front end of the first vane 16. For example, the first vane 16 may include a plurality of first vanes 16*a*, 16*b*, and 16*c* spaced apart from each other in the up-down direction.

Figure 5:
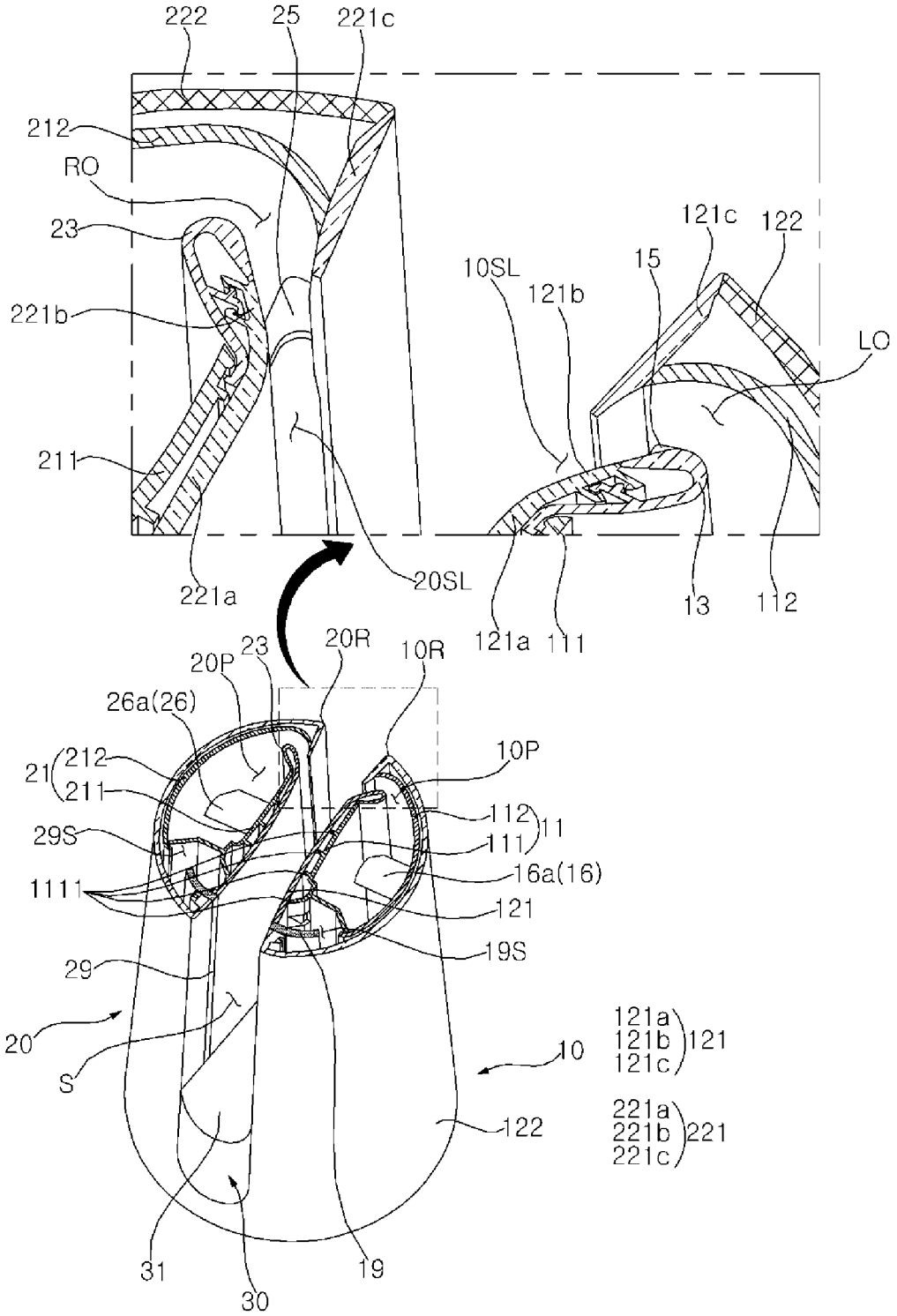
FIG. 5 is a perspective view illustrating an internal configuration of the first upper body and the second upper body of the blower by cutting out a portion thereof according to an embodiment of the present disclosure.

Meanwhile, a second vane 26*a* may be installed in the second flow path 20P, and the above-described contents may be identically applied to the first vane 16 (refer to FIG. 5).

Accordingly, the first vane 16 may smoothly guide the air rising in the first flow path 10P in the rearward direction. In addition, the second vane 16 may smoothly guide the air rising in the second flow path 20P in the rearward direction.

Referring to FIG. 5, a first connecting member 13 may be located in the first flow path 10P, and the rear end of the first vane 16 may be connected thereto.

The first connecting member 13 may extend from the first inner wall 111 to be inclined to the left toward the rearward direction. In addition, the first connecting member 13 may be adjacent to the first rear end 10R of the first upper body 10, and may be spaced apart from the first outer wall 112. In this case, a portion of a first opening LO may be located between the first connecting member 13 and the first outer wall 112, and may be inclined to the right toward the forward direction. Here, the first opening LO may communicate with the first flow path 10P. Meanwhile, the first opening LO may be referred to as a first discharge port or a first mouse.

Accordingly, the air flowing through the first flow path 10P may be guided in the rearward direction by the first vane 16, and may flow into an inlet of the first opening LO.

The first slit 10SL may be adjacent to the first rear end 10R of the first upper body 10, and may be formed through the first inner panel 121. The first slit 10SL may extend long along the first rear end 10R of the first upper body 10. The first slit 10SL may be an outlet of the first opening LO. Accordingly, the first slit 10SL may discharge the air flowing through the first flow path 10P to the space S. Meanwhile, the first slit 10SL may be referred to as a first discharge hole.

A second connecting member 23 may be located in the second flow path 20P, and the rear end of the second vane 26 may be connected thereto.

The second connecting member 23 may extend from the second inner wall 211 to be inclined to the right toward the rearward direction. In addition, the second connecting member 23 may be adjacent to the second rear end 20R of the second upper body 20, and may be spaced apart from the second outer wall 212. In this case, a portion of a second opening RO may be located between the second connecting member 23 and the second outer wall 212, and may be inclined to the left toward the forward direction. Here, the second opening RO may communicate with the second flow path 20P. Meanwhile, the second opening RO may be referred to as a second discharge port or a second mouse.

Accordingly, the air flowing through the second flow path 20P may be guided in the rearward direction by the second vane 26 and may flow into the inlet of the second opening RO.

A second slit 20SL may be adjacent to the second rear end 20R of the second upper body 20, and may be formed to penetrate the second inner panel 221. The second slit 20SL may extend long along the second rear end 20R of the second upper body 20. The second slit 20SL may be an outlet of the second opening RO. Accordingly, the second slit 20SL may discharge the air flowing through the second flow path 20P to the space S. Meanwhile, the second slit 20SL may be referred to as a second discharge hole.

For example, the first connecting member 13 and the second connecting member 23 may be symmetrical left and right, and the first slit 10SL and the second slit 20SL may face each other. In this case, the first opening LO may be inclined or bent in the forward direction of the second slit 20SL. In addition, the second opening RO may be inclined or bent in the forward direction of the first slit 10SL. Meanwhile, the first slit 10SL and the second slit 20SL may be hidden from a user's gaze looking from the forward direction to the rearward direction of the blower 1 (refer to FIG. 1).

A first slot 10H (refer to FIG. 1) may be adjacent to the first front end 10F of the first upper body 10, and may be formed to penetrate the first inner panel 121. The first slot 10H may be formed to extend long along the first front end 10F. A first damper 19 may be installed in a first space 19S and may extend long along the first slot 10H. The first damper 19 may have an arc-shaped lateral cross-section. A first moving assembly (not shown) may be installed in the first space 19S and may move the first damper 19 in the circumferential direction of the first damper 19. Accordingly, the first damper 19 may close the first slot 10H and may pass through the first slot 10H.

A second slot 20H (refer to FIG. 1) may be adjacent to the second front end 20F of the second upper body 20 and may be formed to penetrate the second inner panel 221. A second slot 20H may be formed to extend long along the second front end 20F. A second damper 29 may be installed in a second space 29S and may extend long along the second slot 20H. The second damper 29 may have an arc-shaped lateral cross-section. A second moving assembly (not shown) may be installed in the second space 29S, and may move the second damper 29 in the circumferential direction of the second damper 29. Accordingly, the second damper 29 may close the second slot 20H, and may pass through the second slot 20H.

For example, the first or second moving assembly may have a rack-pinion coupling structure, a pulley-belt coupling structure, a link coupling structure, or the like that can transmit the rotational force of electric motor to the first or second damper 19, 29. For another example, the first or second moving assembly may have a connecting structure, or the like that can transmit the driving force of actuator to the first or second damper 19, 29.

Figure 6:
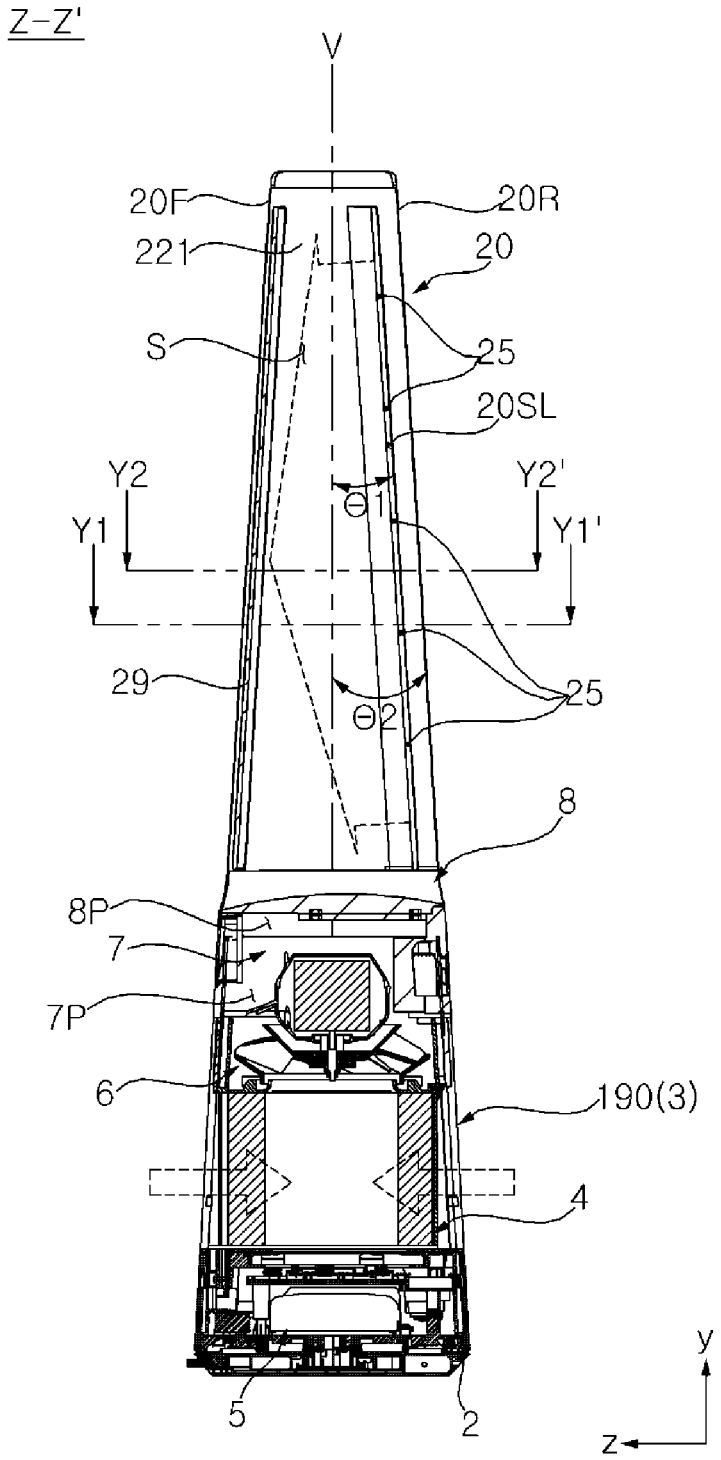
FIG. 6 is a cross-sectional view taken along line Z-Z' of FIG. 1.

Referring to FIGS. 5 and 6, the second slit 20SL may discharge air flowing through the second flow path 20P into the space S. The second slit 20SL may be formed adjacent to the second rear end 20R of the second upper body 20, and penetrate the second inner panel 221. The second slit 20SL may extend long along the second rear end 20R. In this case, the second slit 20SL may be inclined at a certain angle (acute angle) in a forward direction with respect to a vertical line V extending in the up-down direction.

For example, the second slit 20SL may be parallel to the second rear end 20R. As another example, the second slit 20SL may not be parallel to the second rear end 20R. In this case, the second slit 20SL may be inclined at a first angle (theta 1, e.g. 4 degrees) with respect to the vertical line V, and the second rear end 20R may be inclined at a second angle (theta 2, e.g. 3 degrees) smaller than the first angle (theta 1) with respect to the vertical line V.

Meanwhile, the first slit 10SL and the second slit 20SL may be symmetrical while facing each other in the left-right direction.

Figure 7:
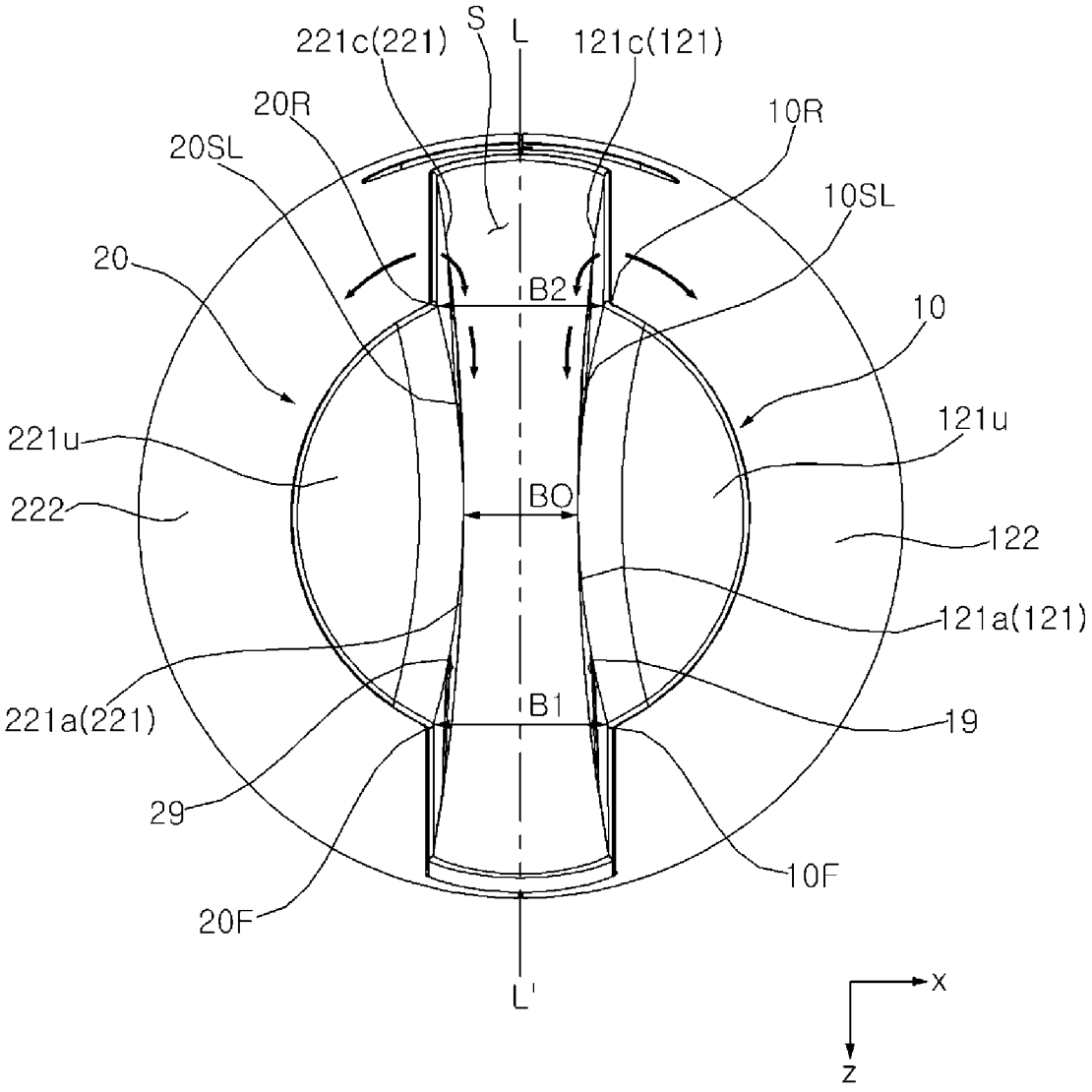
FIGS. 7 and 8 are views for explaining a diffusion airflow formed in a first state of a blower according to an embodiment of the present disclosure.

Referring to FIG. 7, the first inner panel 121 and the second inner panel 221 may face each other, and form left and right boundaries of the space S. A gap between the first inner panel 121 and the second inner panel 221 may decrease as it progresses from the rearward direction to the forward direction and then increase again. The gap may be the width of the space S.

A first gap B1 may be defined as a gap between the first front end 10F of the first upper body 10 and the second front end 20F of the second upper body 20. A second gap B2 may be defined as a gap between the first rear end 10R of the first upper body 10 and the second rear end 20R of the second upper body 20. The second gap B2 may be the same as or different from the first gap G1. A reference gap B0 may be the smallest of the gaps between the first inner panel 121 and the second inner panel 221.

Figure 8:
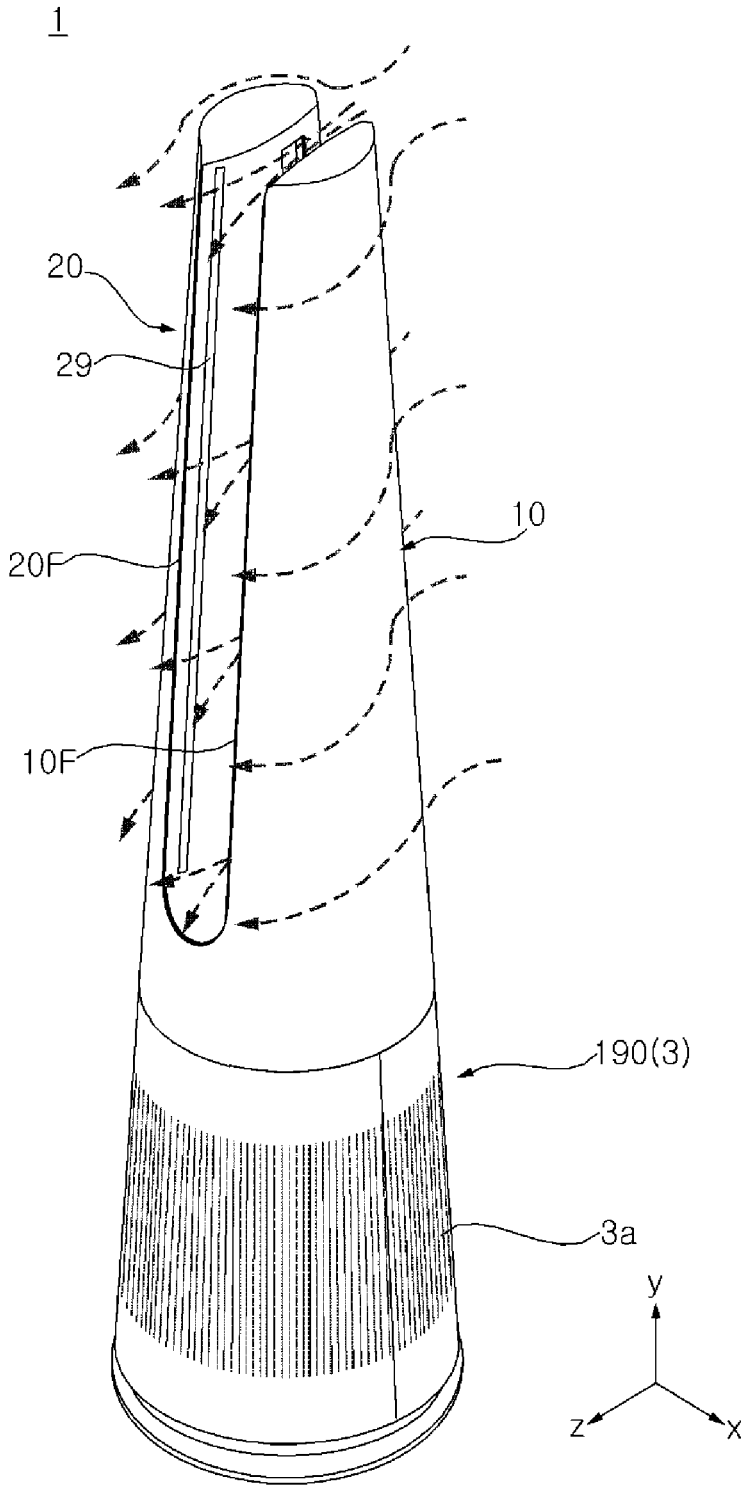

Referring to FIGS. 7 and 8, in the first state of the blower 1, the distal end of the first damper 19 can be inserted or hidden in the first slot 10H, and the distal end of the second damper 29 may be inserted or hidden in the second slot 20H. In this case, the distal end of the first damper 19 may form a surface continuous with the surface of the first inner panel 121, and the distal end of the second damper 29 may form a surface continuous with the surface of the second inner panel 221.

Air may be discharged from the first slit 10SL and the second slit 20SL to the space S, in response to the operation of the fan 6 (refer to FIG. 2). In addition, the air discharged to the space S may flow in the forward direction along the surface of the first inner panel 121 and the surface of the second inner panel 221.

This air flow may form an air current that allows the air around the upper body 10, 20 to be entrained into the space S or to move in the forward direction along the surface of the first outer panel 122 and the surface of the second outer panel 222.

Accordingly, the blower 1 can provide an air current of abundant airflow to a user or the like.

Figure 9:
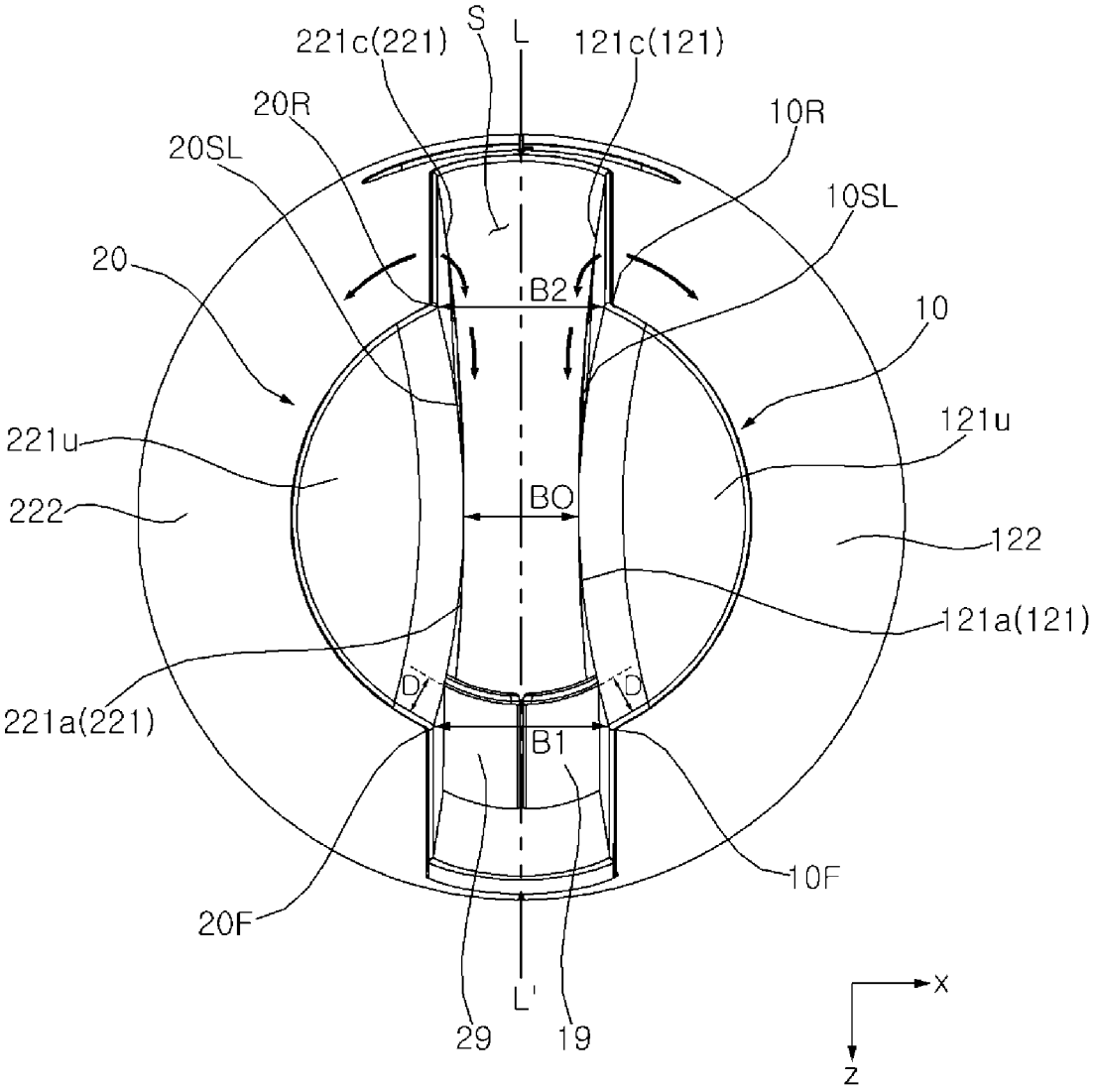
FIGS. 9 and 10 are views for explaining an upward airflow formed in a second state of the blower according to an embodiment of the present disclosure.
Figure 10:
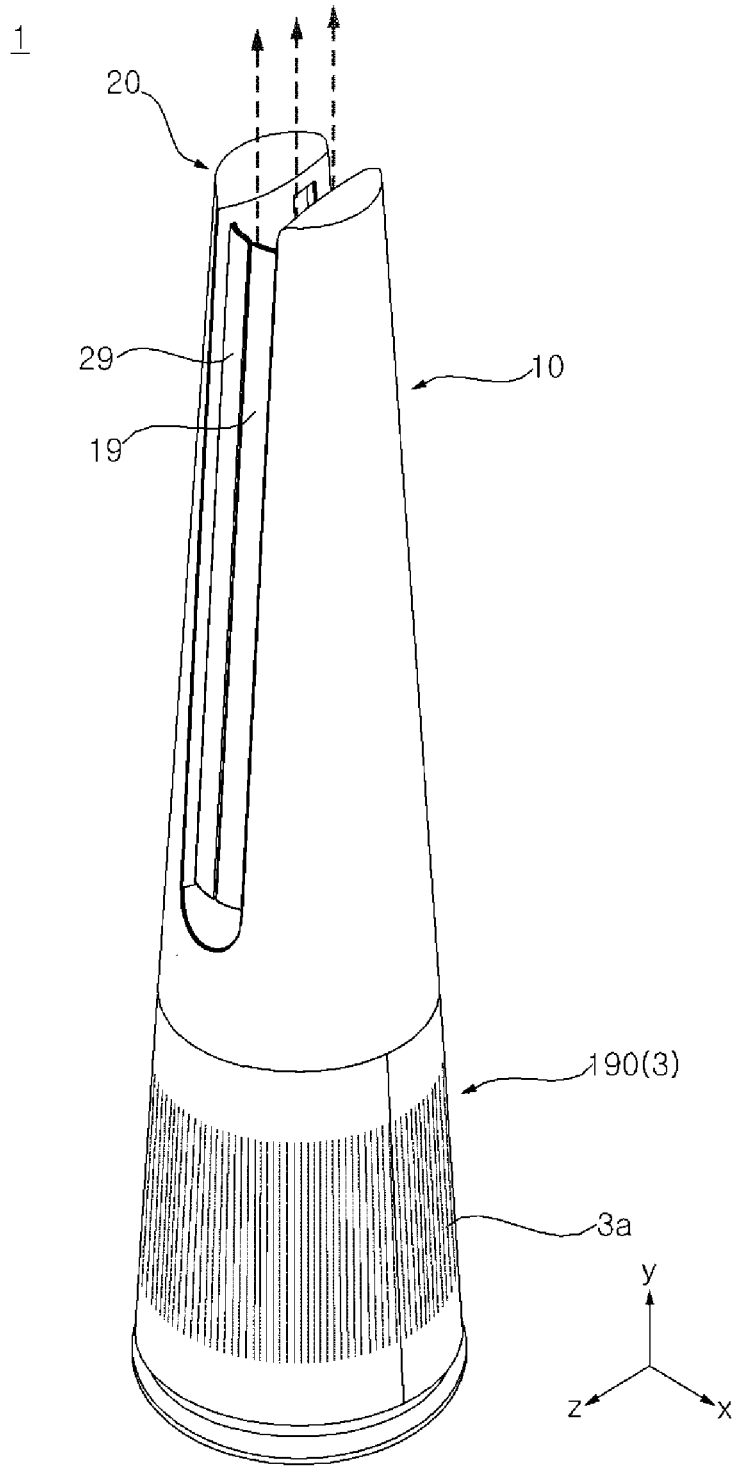

Referring to FIGS. 9 and 10, in the second state of the blower 1, a portion of the first damper 19 may pass through the first slot 10H and may be located in the space S, and a portion of the second damper 29 may pass through the second slot 20H and may be located in the space S. In this case, the distal end of the first damper 19 and the distal end of the second damper 29 may be in contact with or adjacent to each other.

Air may be discharged from the first slit 10SL and the second slit 20SL into the space S, in response to the operation of the fan 6 (refer to FIG. 2). Then, the air discharged into the space S may flow in the forward direction along the surface of the first inner panel 121 and the surface of the second inner panel 221, and then may be obstructed by the first damper 19 and the second damper 29 and may ascend upwards.

Accordingly, the blower 1 may provide an upward airflow, and may circulate air in the indoor space in which the blower 1 is installed.

Figure 11:
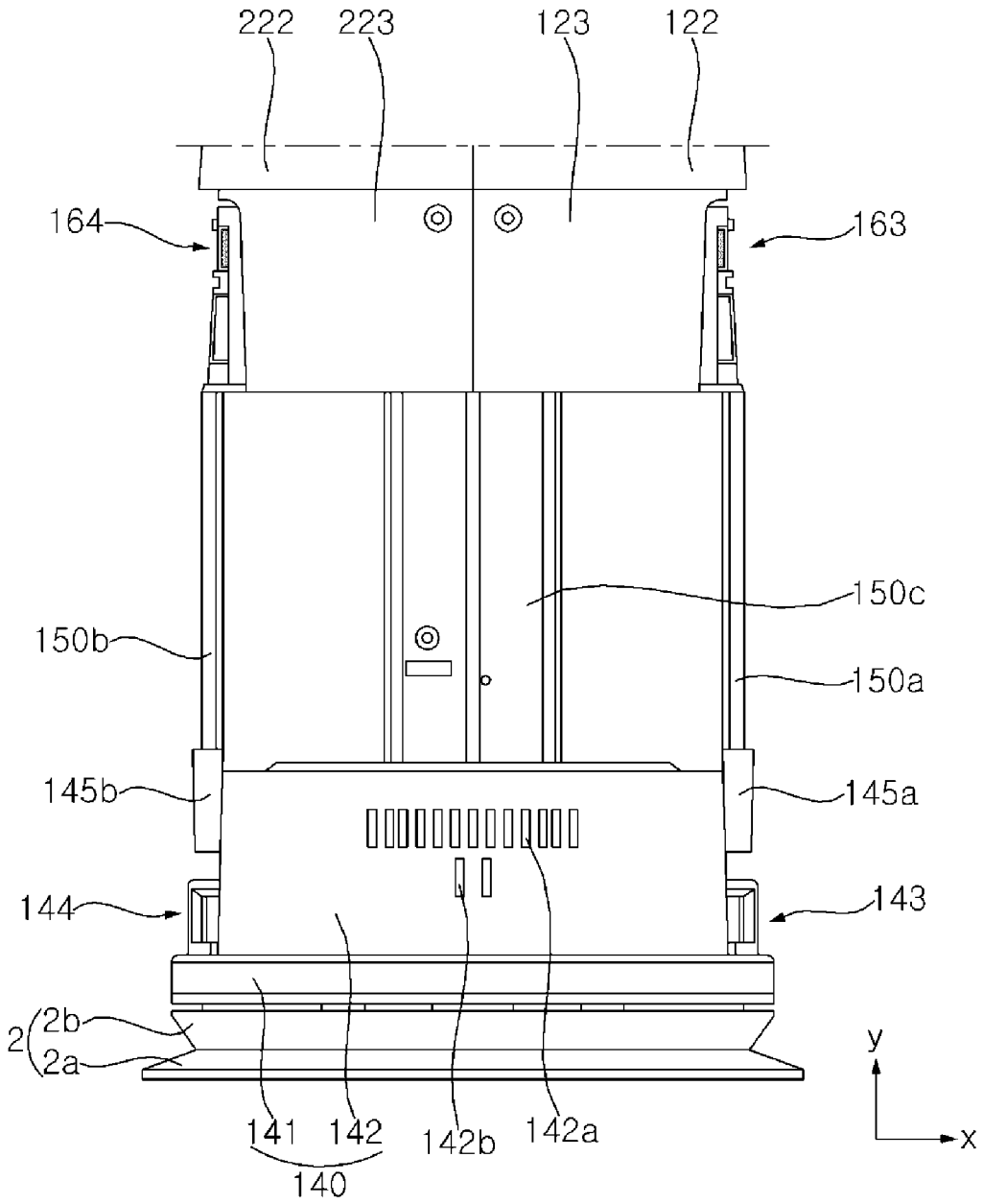
FIGS. 11 and 12 are views for explaining a housing, columns, a lower panel, and coupling portions of the blower according to an embodiment of the present disclosure.
Figure 12:
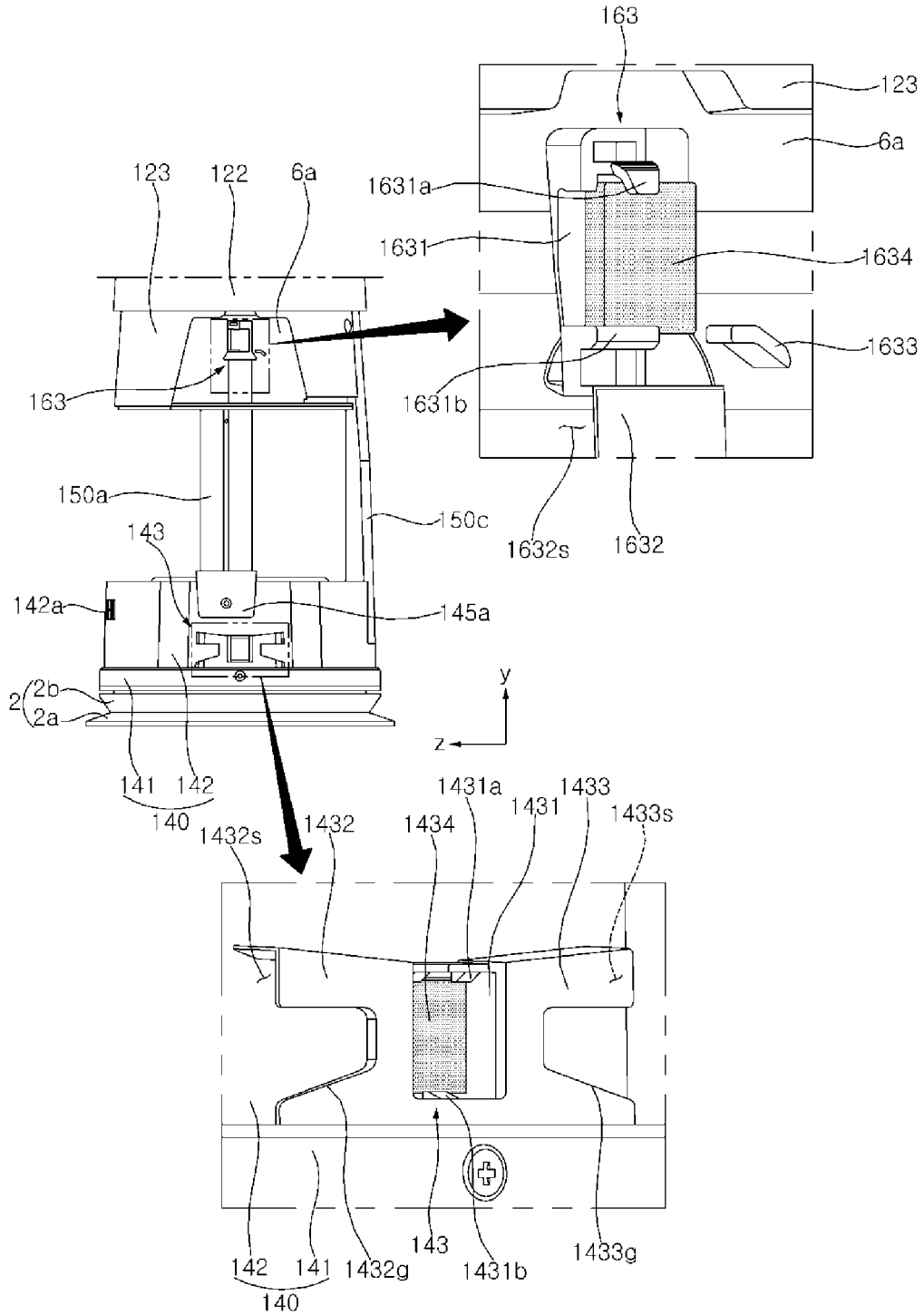

Referring to FIGS. 11 and 12, the base 2 may include a lower base 2*a* and an upper base 2*b*. The lower base 2*a* may form a lower surface of the base 2. The upper base 2*b* may extend upwardly from the lower base 2*a*. The diameter of the upper base 2*b* may be smaller than the diameter of the lower base 2*a*.

The housing 140 may be located in the upper side of the base 2. The housing 140 may include a bottom 141 and a body 142. The bottom 141 may be coupled to the upper end of the upper base 2*b*. The body 142 may extend upwardly from the bottom 141. The body 142 may have a cylindrical shape. The diameter of the body 142 may be smaller than the diameter of the bottom 141. The height of the body 142 may be greater than the height of the bottom 141. The controller 5 described above with reference to FIG. 2 may be installed in the inner space of the housing 140.

The first lower panel 123 may be formed while being pressed to the inner side of the first outer panel 122 from the lower portion of the first outer panel 122 (refer to FIG. 3). A step may be formed between the first outer panel 122 and the first lower panel 123. The first lower panel 123 may extend along the first outer panel 122.

The second lower panel 223 may be formed while being pressed to the inner side of the second outer panel 222 from the lower portion of the second outer panel 222 (refer to FIG. 3). A step may be formed between the second outer panel 222 and the second lower panel 223. The second lower panel 223 may extend along the second outer panel 222.

The distal end of the first lower panel 123 may contact the distal end of the second lower panel 223. The first lower panel 123 and the second lower panel 223 may be coupled to the fan housing 6*a* described above with reference to FIG. 2. The first lower panel 123 and the second lower panel 223 may surround at least a portion of a side surface of the fan housing 6*a*. The first lower panel 123 and the second lower panel 223 may be collectively referred to as a lower panel 123, 223. The lower panel 123, 223 may be spaced upwardly from the housing 140.

For example, a portion of the fan housing 6*a* may be exposed to the outer side of the lower panel 123, 223 through the opening formed in the left and right sides of the lower panel 123, 223. The portion of the fan housing 6*a* may be referred to as a middle base.

A plurality of columns 150*a*, 150*b*, 150*c* may be coupled to the housing 140 and the lower panel 123, 223 at between the housing 140 and the lower panel 123, 223. The plurality of columns 150*a*, 150*b*, and 150*c* may extend long in the up-down direction. In addition, the plurality of columns 150*a*, 150*b*, 150*c* may be spaced apart from each other in the circumferential direction of the body 142. The plurality of columns 150*a*, 150*b*, 150*c* may be located within a 180 degree range. The plurality of columns 150*a*, 150*b*, 150*c* may be disposed in a rear direction area of the body 142.

For example, the lower end of a first column 150*a* may be coupled to the outer circumferential surface of the body 142 through a first holder 145*a*, and the upper end of the first column 150*a* may be coupled to the lower end of the middle base of the fan housing 6*a*. The lower end of a second column 150*b* may be coupled to the outer circumferential surface of the body 142 through a second holder 145*b*, and the upper end of the second column 150*b* may be coupled to the lower end of the middle base of the fan housing 6*a*. The second column 150*b* may face the first column 150*a*. The lower end of a third column 150*c* may be coupled to the outer circumferential surface of the body 142, and the upper end of the third column 150*c* may be coupled to the outer circumferential surface of the lower panel 123, 223. In the circumferential direction of the body 142, the third column 150*c* may be located between the first column 150*a* and the second column 150*b*.

A lower coupling portion (or lower coupling) 143, 144 may be provided on the outer circumferential surface of the body 142. The lower coupling portion 143, 144 may be adjacent to the lower end of the body 142. A first lower coupling portion (or first lower coupler) 143 may be located in the lower side of the first holder 145*a*, and a second lower coupling portion (or second lower coupler) 144 may be located in the lower side of the second holder 145*b*. The first lower coupling portion 143 and the second lower coupling portion 144 may be spaced apart from each other by 180 degrees in the circumferential direction of the body 142. For example, the second lower coupling portion 144 may be symmetrical to the left and right with the first lower coupling portion 143. In this case, the description of the first lower coupling portion 143 may be identically applied to the second lower coupling portion 144.

The first lower coupling portion 143 may include a lower seating portion 1431, a lower magnet 1434, and a lower insertion portion 1432, 1433. For example, the lower seating portion 1431 and the lower insertion portion 1432, 1433 may be formed as one body with the body 142.

The lower seating portion 1431 may be formed to be flat, and may provide a vertical surface. For example, the lower seating portion 1431 may form a portion of the body 142. In this case, the outer surface of the body 142 may include a flat portion in which the lower seating portion 1431 is formed and a curved portion connected to the lower seating portion 1431.

The lower magnet 1434 may be seated on the lower seating portion 1431. The lower magnet 1434 may have a rectangular parallelepiped shape as a whole.

The lower insertion portion 1432, 1433 may protrude from the lower seating portion 1431 and may extend in the front-rear direction along the lower seating portion 1431. The lower insertion portion 1432, 1433 may be symmetrical front and rear with respect to the lower magnet 1434. The lower insertion portion 1432, 1433 may include a first insertion portion 1432 and a second insertion portion 1433 facing each other with respect to the lower magnet 1434. A first slot 1432*s* may be formed between the lower seating portion 1431 and the first insertion portion 1432. A second slot 1433*s* may be formed between the lower seating portion 1431 and the second insertion portion 1433. The lower magnet 1434 may be disposed between the first slot 1432*s* and the second slot 1433*s*.

In addition, the first insertion portion 1432 may include a first groove 1432*g* formed inside the first insertion portion 1432 at the front end of the first insertion portion 1432. The second insertion portion 1433 may include a second groove 1433*g* formed inside the second insertion portion 1433 at the rear end of the second insertion portion 1433.

A first lower stopper 1431*a* may protrude toward the lower magnet 1434 from the upper end of the lower insertion portion 1432, 1433, and may contact the surface of the lower magnet 1434. A second lower stopper 1431*b* may protrude toward the lower magnet 1434 from the lower end of the lower insertion portion 1432, 1433, and may contact the surface of the lower magnet 1434. Accordingly, the first lower stopper 1431*a* and the second lower stopper 1431*b* may prevent the lower magnet 1434 from being separated from the lower seating portion 1431.

An upper coupling portion 163, 164 may be provided on the outer peripheral surface of the middle base of the fan housing 6*a*. The upper coupling portion 163, 164 may be adjacent to the upper end of the middle base. A first upper coupling portion 163 may be located in the upper side of the upper end of a first column 150*a*, and a second upper coupling portion 164 may be located in the upper side of the upper end of a second column 150*b*. The first upper coupling portion 163 and the second upper coupling portion 164 may be spaced apart from each other by 180 degrees in the circumferential direction of the fan housing 6*a*. For example, the second upper coupling portion 164 may be symmetrical to the left and right with the first upper coupling portion 163. In this case, the description of the first upper coupling portion 163 may be identically applied to the second upper coupling portion 164.

The first upper coupling portion 163 may include an upper seating portion 1631, an upper magnet 1634, and an upper insertion portion 1632. For example, the upper seating portion 1631 and the upper insertion portion 1632 may be formed as one body with the fan housing 6*a*.

The upper seating portion 1631 may be formed to be flat, and may provide a vertical surface. For example, the upper seating portion 1631 may form a portion of the fan housing 6*a*. In this case, the outer surface of the fan housing 6*a* may include a flat portion in which the upper seating portion 1631 is formed, and a curved portion connected to the upper seating portion 1631.

The upper magnet 1634 may be seated on the upper seating portion 1631. The upper magnet 1634 may have a rectangular parallelepiped shape as a whole.

The upper insertion portion 1632 may protrude from the upper seating portion 1631 and may extend downward from the lower end of the upper seating portion 1631. An upper slot 1632*s* may be formed between the fan housing 6*a* and the upper insertion portion 1632, and may be opened back and forth.

A first upper stopper 1631*a* may protrude from the upper end of the upper seating portion 1631, and the distal end of the first upper stopper 1631*a* may be bent to contact the surface of the upper magnet 1634. A second upper stopper 1631*b* may protrude from the lower end of the upper seating portion 1631, and the distal end of the second upper stopper 1631*b* may be bent to contact the surface of the upper magnet 1634. Accordingly, the first upper stopper 1631*a* and the second upper stopper 1631*b* may prevent the upper magnet 1634 from being separated from the upper seating portion 1631.

The upper guide 1633 may protrude from the fan housing 6*a*, and may be spaced apart from the upper seating portion 1631. One portion of the upper guide 1633 may be adjacent to the rear side of the upper magnet 1634, and may be disposed parallel to the lower side of the upper magnet 1634. Another portion of the upper guide 1633 may extend to be inclined downwardly from the one portion.

The aforementioned lower coupling portion 143, 144 may be aligned with the upper coupling portion 163, 164. In the up-down direction, the first lower coupling portion 143 may be aligned with the first upper coupling portion 163, and the second lower coupling portion 144 may be aligned with the second upper coupling portion 164.

Figure 13:
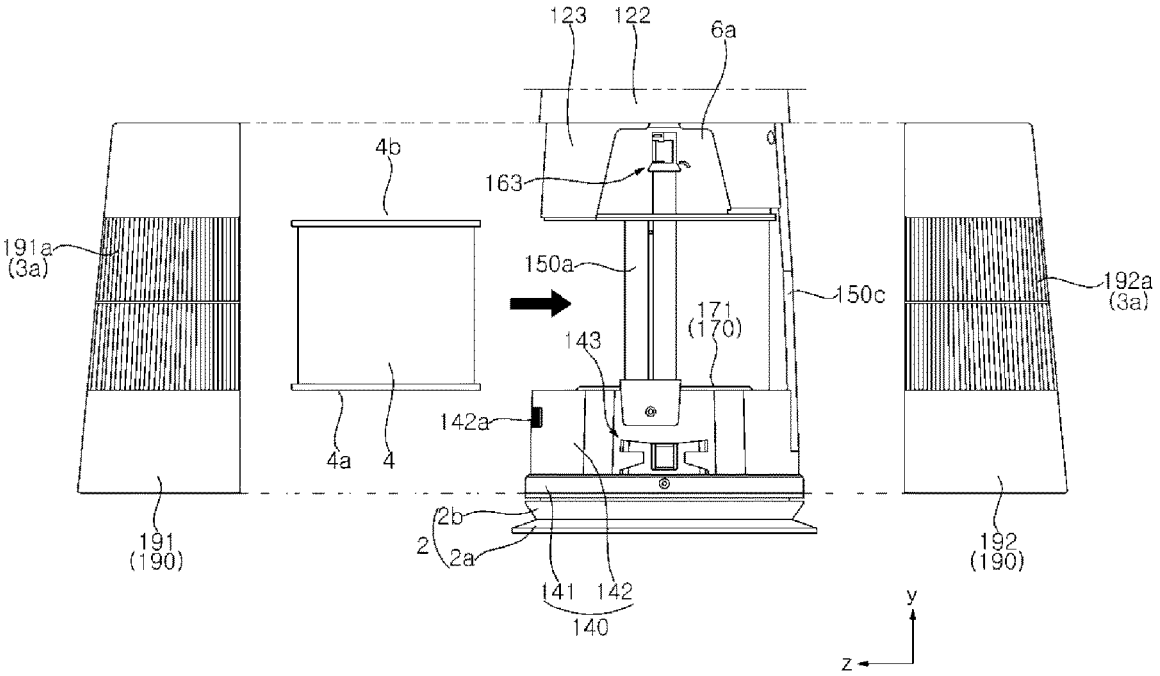
FIG. 13 is a view for explaining the assembly and separation of a filter and a case for the blower according to an embodiment of the present disclosure.

Referring to FIGS. 11 and 13, the filter 4 may be inserted into or separated from the space between the housing 140 and the fan housing 6*a* while avoiding an area where the plurality of columns 150*a*, 150*b*, and 150*c* are disposed. That is, the first column 150*a* may be located in the left side of the filter 4, the second column 150*b* may be located in the right side of the filter 4, and the third column 150*c* may be located in the rear direction of the filter 4.

The case 190 may surround the housing 140, the lower panel 123, 223, and a space between the housing 140 and the lower panel 123, 223. The case 190 may be referred to as a cover. The suction hole 3*a* may be formed to penetrate a portion of the case 190 corresponding to the filter 4. The case 190 may include a first case 191 and a second case 192.

The first case 191 may be convex in the forward direction. The first case 191 may horizontally move from the forward direction to the rearward direction of the housing 140 and the fan housing 6*a*, and the lower coupling portion 143, 144 may be detachably coupled to the upper coupling portion 163, 164.

The second case 192 may be convex in the rearward direction. The second case 192 may horizontally move from the rearward direction to the forward direction of the housing 140 and the fan housing 6*a*, and the lower coupling portion 143, 144 may be detachably coupled to the upper coupling portion 163, 164.

Meanwhile, the lower body 3 described above with reference to FIG. 1 and the like may include the housing 140 and the case 190.

Figure 14:
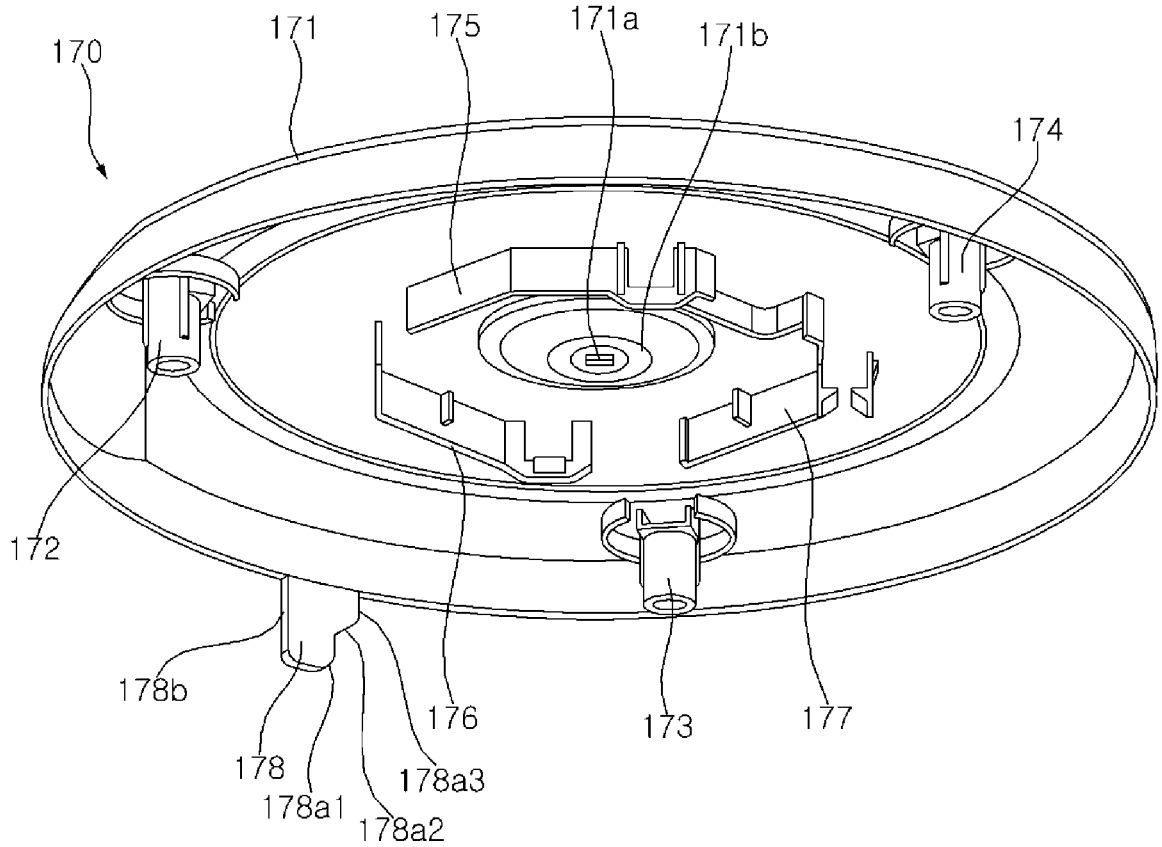
FIG. 14 is a perspective view of a supporter according to an embodiment of the present disclosure.

Referring to FIG. 14, a supporter (or supporter tray) 170 may include a seating portion (or seating base) 171, a plurality of coupling portions (or coupling bosses) 172, 173, 174, a plurality of ribs 175, 176, 177, and a vertical protrusion 178.

A seating portion 171 may form an upper surface and a side surface of the supporter 170. For example, the central portion of the upper surface of the seating portion 171 may be located above an edge portion. A side surface of the seating portion 171 may extend along an edge of the upper surface of the seating portion 171, and may form a lower end of the seating portion 171. The seating portion 171 may have a disk shape as a whole.

A recession portion (or supporter recess) 171*b* may be formed while being recessed downward from the upper surface of the seating portion 171. For example, the recession portion 171*b* may be located at the center of the seating portion 171. A hole 171*a* may be formed by vertically penetrating the recession portion 171*b*. For example, the hole 171*a* may be formed in the center of the recession portion 171*b*.

The plurality of coupling portions 172, 173, and 174 may protrude downward from the inner surface of the seating portion 171. The plurality of coupling portions 172, 173, and 174 may be spaced apart from each other in the circumferential direction of the seating portion 171, and may be adjacent to a portion forming the side surface of the seating portion 171. For example, the plurality of coupling portions 172, 173, and 174 may be spaced apart from each other at regular intervals in the circumferential direction of the seating portion 171. For example, the plurality of coupling portions 172, 173, and 174 may include a first coupling portion 172, a second coupling portion 173, and a third coupling portion 174.

The plurality of ribs 175, 176, and 177 may protrude downward from the inner surface of the seating portion 171. The plurality of ribs 175, 176, and 177 may be adjacent to the recession portion 171*b*. The plurality of ribs 175, 176, and 177 may be spaced apart from or in contact with each other in the circumferential direction of the recession portion 171*b*. For example, the plurality of ribs 175, 176, and 177 may include a first rib 175, a second rib 176, and a third rib 177.

The vertical protrusion 178 may protrude downward from the lower end of the seating portion 171. The vertical protrusion 178 may be formed in a portion of the lower end of the seating portion 171. One side 178*a* and the other side 178*b* of the vertical protrusion 178 may face each other in the circumferential direction of the seating portion 171. One side 178*a* may include a vertical portion 178*a*1, an inclined portion 178*a*2, and a connecting portion 178*a*3. The vertical portion 178*a*1 may extend in the up-down direction, and may form a portion of the lower end of the vertical protrusion 178. The inclined portion 178*a*2 may extend from the upper end of the vertical portion 178*a*1 in a direction away from the other side 178*b*. An angle between the inclined portion 178*a*2 and the vertical portion 178*a*1 may be an obtuse angle. The connecting portion 178*a*3 may extend upwardly from the upper end of the inclined portion 178*a*2, and may be connected to the lower end of the seating portion 171. In this case, the inclined portion 178*a*2 may form a step between the vertical portion 178*a*1 and the connecting portion 178*a*3.

Figure 15:
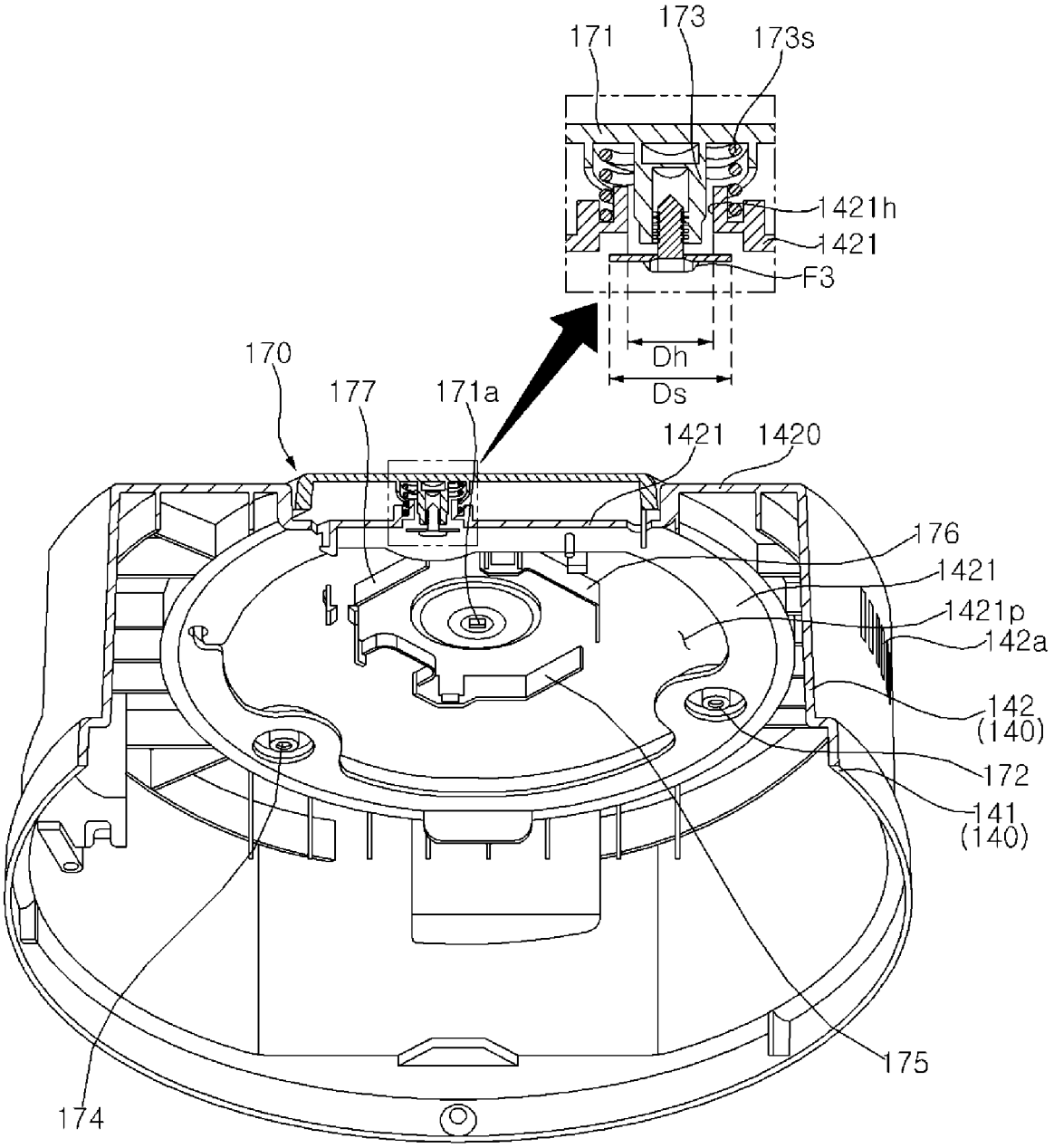
FIG. 15 is a view for explaining a coupling of supporter for the housing according to an embodiment of the present disclosure.
Figure 16:
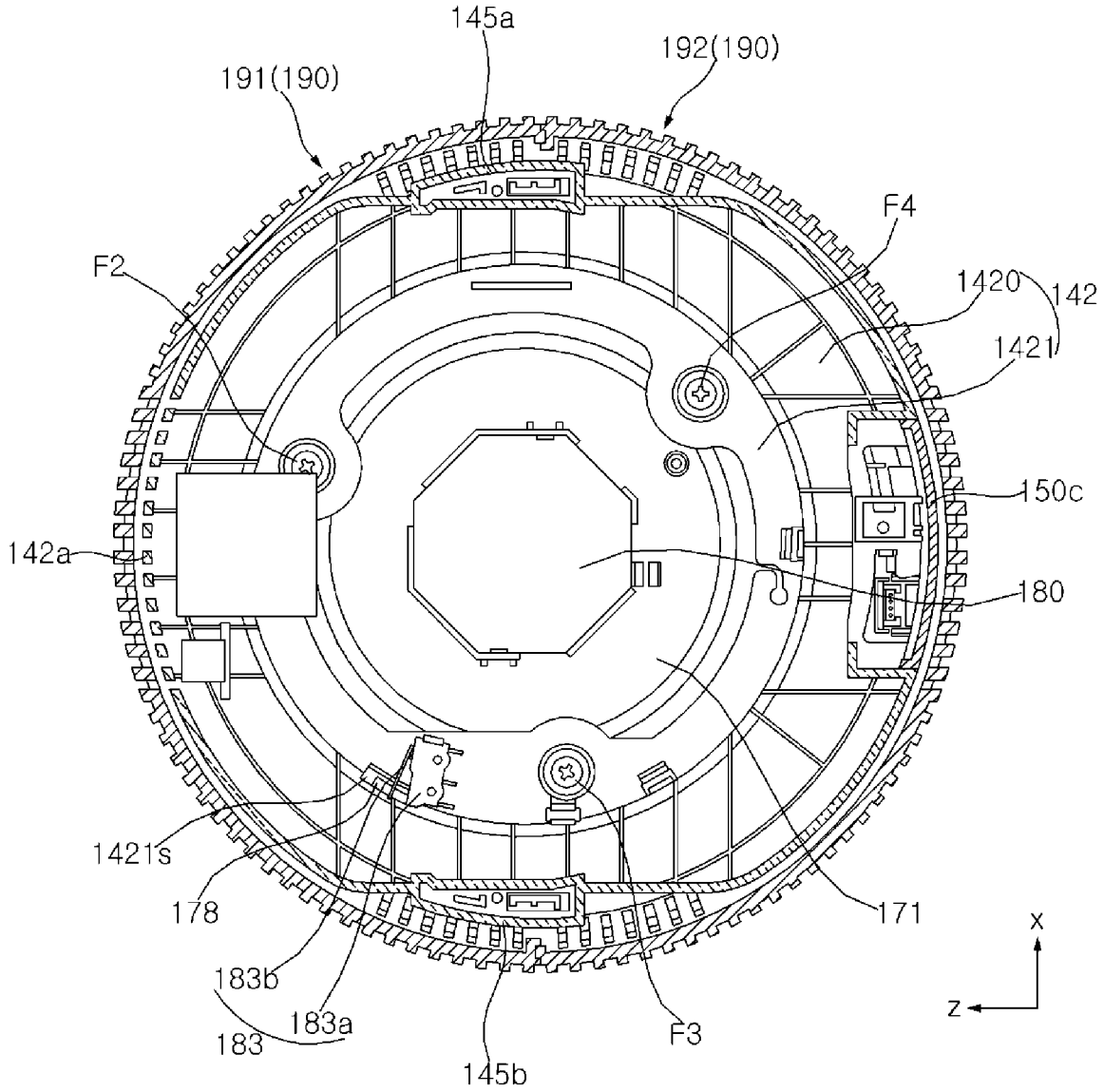
FIG. 16 is a view for explaining a board, a top switch, and a vertical protrusion according to an embodiment of the present disclosure.

Referring to FIGS. 15 and 16, a groove 1421 may be formed while being recessed downward from the upper surface 1420 of the housing 140. An opening 1421*p* may be formed by penetrating the groove 1421 in the up-down direction. In this case, the groove 1421 may extend along the circumferential direction of the housing 140.

The supporter 170 may be located on the groove 1421 and may cover the opening 1421*p*. The plurality of coupling portions 172, 173, and 174 of the supporter 170 may be coupled to the groove 1421. The plurality of coupling portions 172, 173, and 174 may penetrate a coupling hole 1421*h* of the groove 1421, and may be coupled to a plurality of coupling members F2, F3, and F4. For example, a thread may be formed on the inner circumferential surface of each of the plurality of coupling portions 172, 173, and 174, and each of the plurality of fastening members (or fasteners) F2, F3, and F4 may be a screw fastened to the inner circumferential surface. In this case, the size or diameter Ds of a head of the screw may be larger than the size or diameter Dh of the coupling hole 1421*h*.

An elastic member (or spring) 173*s* may have elasticity. The elastic member 173*s* may be located between the seating portion 171 and the groove 1421, and may be fixed to the seating portion 171 and the groove 1421. For example, the elastic member 173*s* may be a spring, and may be wound around the outer circumferential surface of each of the plurality of coupling portions 172, 173, 174.

When a load is applied to the seating portion 171, the elastic member 173*s* may be compressed, and the seating portion 171 may move toward the groove 1421. The descending of the seating portion 171 may be restricted by the contact between the seating portion 171 and the groove 1421. In addition, when the seating portion 171 is in contact with the groove 1421, the seating portion 171 may be disposed parallel to the upper surface 1420 of the body 142.

If no load is applied to the seating portion 171, the elastic member 173*s* may be elastically restored, and the seating portion 171 may move away from the groove 1421. The ascending of the seating portion 171 may be restricted by the contact between the head of the screw and the lower surface of the groove 1421.

Accordingly, the supporter 170 may be vertically movably coupled to the groove 1421 of the housing 140.

Figure 17:
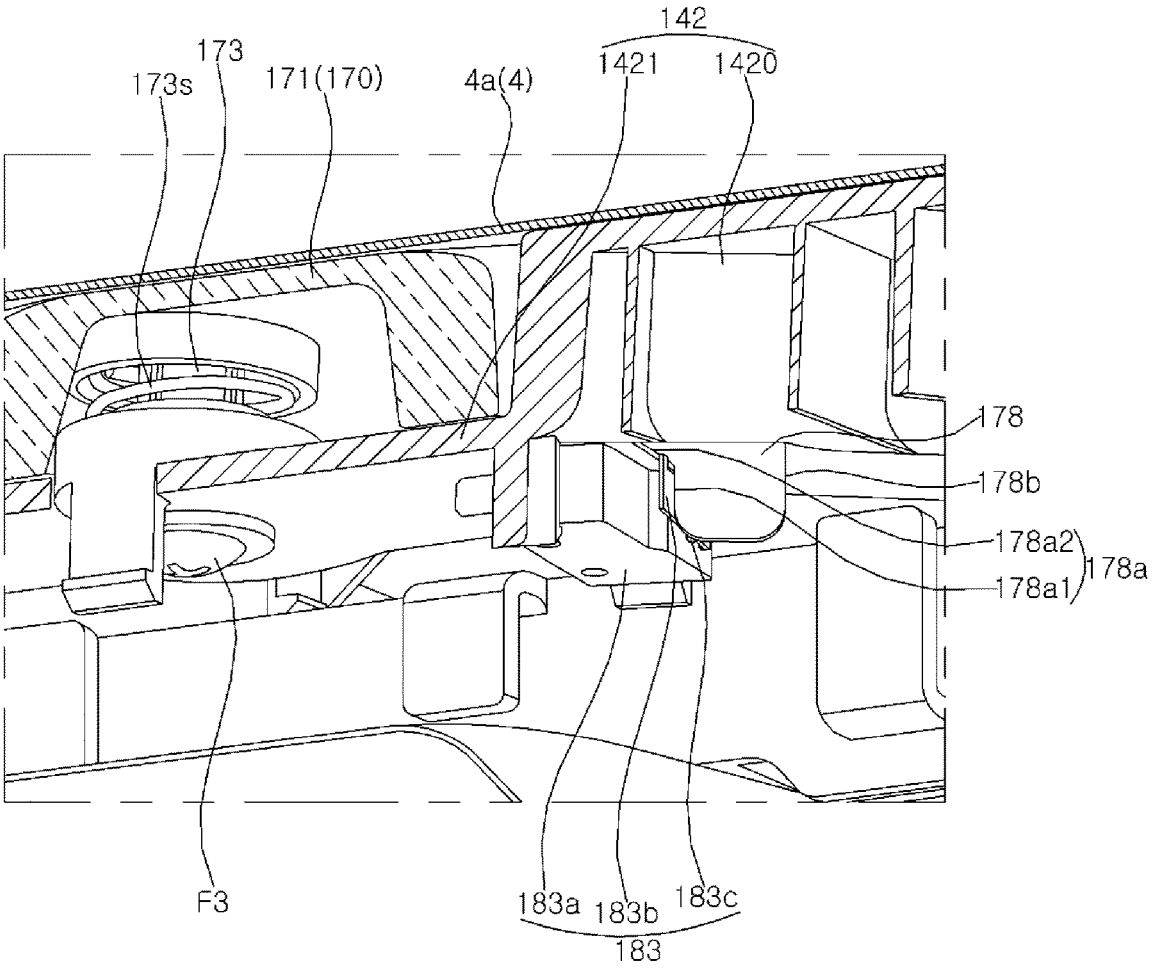
FIG. 17 is a view for explaining a structure in which a vertical protrusion turns on a top switch according to an embodiment of the present disclosure.

Referring to FIGS. 16 and 17, a board 180 may be mounted on the lower surface of the seating portion 171. The board 180 may be located in the upper side of the opening 1421*p* (refer to FIG. 15). The board 180 may be referred to as a substrate. For example, the board 180 may be a printed circuit board (PCB). The plurality of ribs 175, 176, and 177 may surround at least a portion of a side surface of the board 180.

A slot 1421*s* may be formed by penetrating the groove 1421 in the up-down direction. The vertical protrusion 178 may penetrate the groove 1421.

A top switch 183 may be coupled to the lower surface of the groove 1421, and may be adjacent to the slot 1421*s*. The top switch 183 may be electrically connected to the board 180. For example, the top switch 183 may be a micro switch. The top switch 183 may include a switch body 183*a*, a lever 183*b*, and a button 183*c*.

One side of the switch body 183*a* may face the vertical protrusion 178. A common terminal, a normally open (NO) terminal, and a normally closed (NC) terminal may be provided in the other side of the switch body 183*a*. The lever 183*b* may have elasticity. The lever 183*b* may be located between the switch body 183*a* and the vertical protrusion 178, and one end of the lever 183*b* may be fixed to the one side of the switch body 183*a*. A remaining portion excluding the one end of the lever 183*b* may be spaced apart from the one side of the switch body 183*a*. The button 183*c* may be located between the switch body 183*a* and the lever 183*b*, and may be provided in one side of the switch body 183*a*. The button 183*c* may be connected to an elastic member provided inside the switch body 183*a*, and may be referred to as a plunger.

One side 178*a* of the vertical protrusion 178 may contact the lever 183*b* of the top switch 183 at the lower side of the groove 1421.

When the filter 4 is seated on the supporter 170, the lever 183*b* may move in a direction toward the switch body 183*a* along the inclined portion 178*a*2, and may press the button 183*c*. In this case, the supporter 170 may support the filter 4.

If the filter 4 is not seated on the supporter 170, the pressing of button 183*c* can be released, and the button 183*c* may move the lever 183*b* along the inclined portion 178*a*2 in a direction away from the switch body 183*a*.

Accordingly, the top switch 183 may be turned on when the filter 4 is seated on the supporter 170, and may be turned off when the filter 4 is not seated on the supporter 170.

Figure 18:
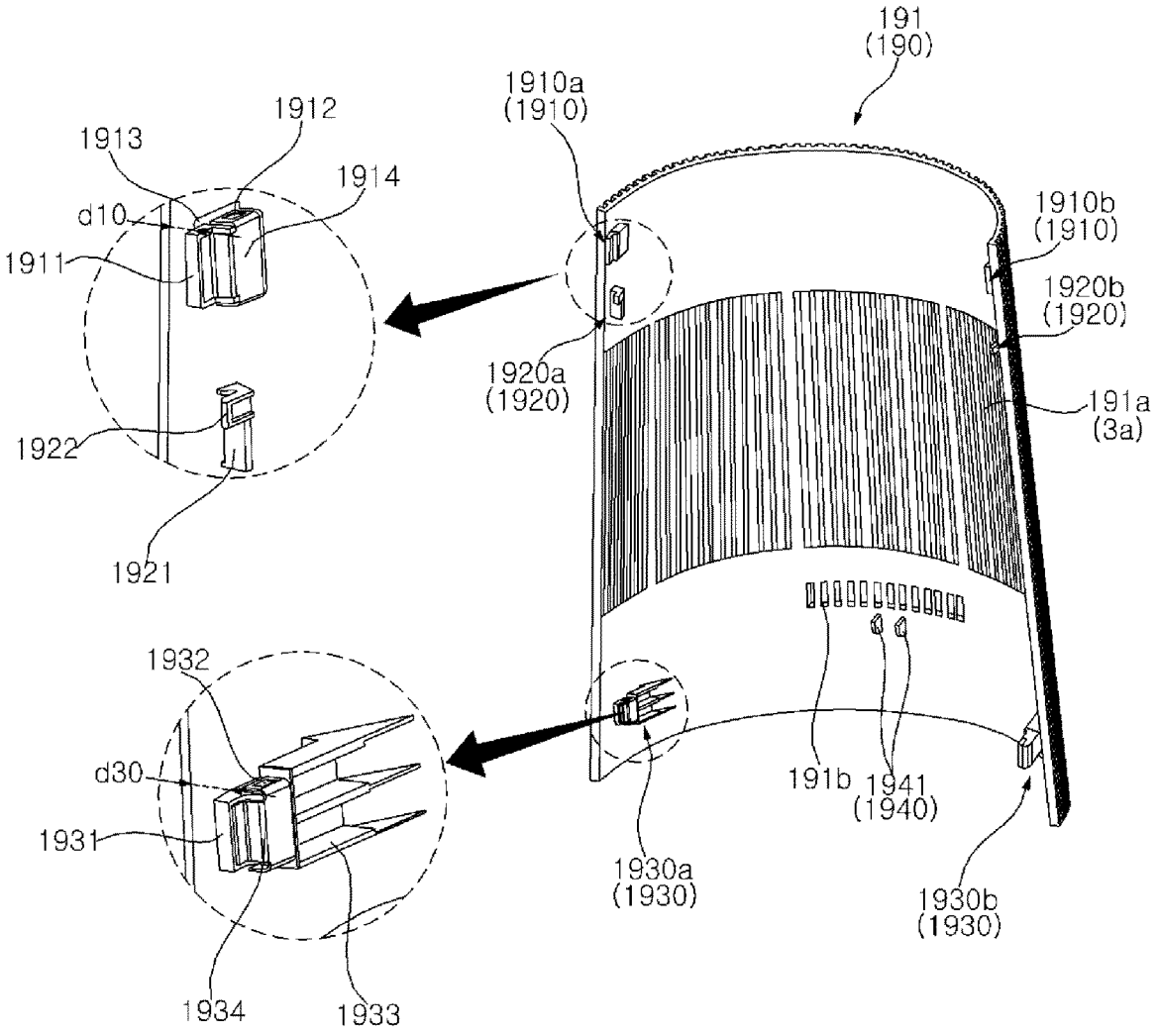
FIG. 18 is a view for explaining a lower protrusion, an upper protrusion, and a locking portion of a case according to an embodiment of the present disclosure.

Referring to FIGS. 13 and 18, the diameter of the case 191 and 192 may decrease as it progress from the lower portion of the case 191 and 192 to the upper portion. The first case 191 may be convex in the forward direction. The second case 192 may be convex in the rearward direction. For example, the first case 191 and the second case 192 may be symmetrical front and rear. In this case, the description of the first case 191 may be identically applied to the second case 192. The first case 191 may include a lower protrusion 1930, an upper protrusion 1910, and a locking portion 1920.

The lower protrusion 1930 may be provided on the inner surface of the first case 191. The lower protrusion 1930 may be adjacent to the lower end and rear end of the first case 191. The lower protrusion 193 may include a first lower protrusion 1930*a* and a second lower protrusion 1930*b* that are spaced apart from each other in the circumferential direction of the first case 191. For example, the first lower protrusion 1930*a* and the second lower protrusion 1930*b* may be symmetrical left and right. In this case, the description of the first lower protrusion 1930*a* may be identically applied to the second lower protrusion 1930*b*. The first lower protrusion 1930*a* may include a lower rib 1933, a lower block 1931, 1936, and a lower plate 1934.

The lower rib 1933 may protrude from the inner surface of the first case 191 and may extend along the front-rear direction. Support ribs 1935 (refer to FIG. 19) may be coupled to the inner surface of the first case 191 and the lower rib 1933 at between the inner surface of the first case 191 and the lower rib 1933.

The lower block 1931 and 1936 (refer to FIG. 19) may be coupled to the rear end of the lower rib 1933. For example, the lower block 1931 and 1936 may be formed as one body with the lower rib 1933. As another example, the lower block 1931 and 1936 may be detachably coupled to the lower rib 1933.

The lower plate 1934 may be located on a surface opposite to the surface facing the first case 191 of the lower block 1931 and 1936. The lower plate 1934 may include a magnetic substance material such as iron. The lower plate 1934 may include a lower bending portion 1932 that is bent at the lower plate 1934 and snap-fitted to the lower block 1931 and 1936.

In addition, the lower plate 1934 may include a first lower part 1934*a*, a second lower part 1934*b*, and a third lower part 1934*c* (refer to FIG. 18). The first lower part 1934*a* may form a front end of the lower plate 1934, and may extend in the front-rear direction. The second lower part 1934*b* may be perpendicular to the first lower part 1934*a*. The third lower part 1934*c* may be perpendicular to the second lower part 1934*b*, and may extend in the front-rear direction.

The upper protrusion 1910 may be provided on the inner surface of the first case 191. The upper protrusion 1910 may be adjacent to the upper end and rear end of the first case 191. The upper protrusion 1910 may include a first upper protrusion 1910*a* and a second upper protrusion 1910*b* that are spaced apart from each other in the circumferential direction of the first case 191. For example, the first upper protrusion 1910*a* and the second upper protrusion 1910*b* may be symmetrical left and right. In this case, the description of the first upper protrusion 1910*a* may be identically applied to the second upper protrusion 1910*b*. The first upper protrusion 1910*a* may include an upper rib 1913, an upper block 1911, and an upper plate 1914.

The upper rib 1913 may protrude from the inner surface of the first case 191, and may extend along the front-rear direction.

The upper block 1911 may be coupled to the upper rib 1913. For example, the upper block 1911 may be formed as one body with the upper rib 1913. As another example, the upper block 1911 may be detachably coupled to the upper rib 1913.

The upper plate 1914 may be located on a surface opposite to the surface facing the first case 191 of the upper block 1911. The upper plate 1914 may include a magnetic substance material such as iron. The upper plate 1914 may include an upper bending portion 1912 that is bent from the upper plate 1914 and snap-fitted to the upper block 1911.

In addition, the upper plate 1914 may include a first upper part 1914*a*, a second upper part 1914*b*, and a third upper part

Figure 20:
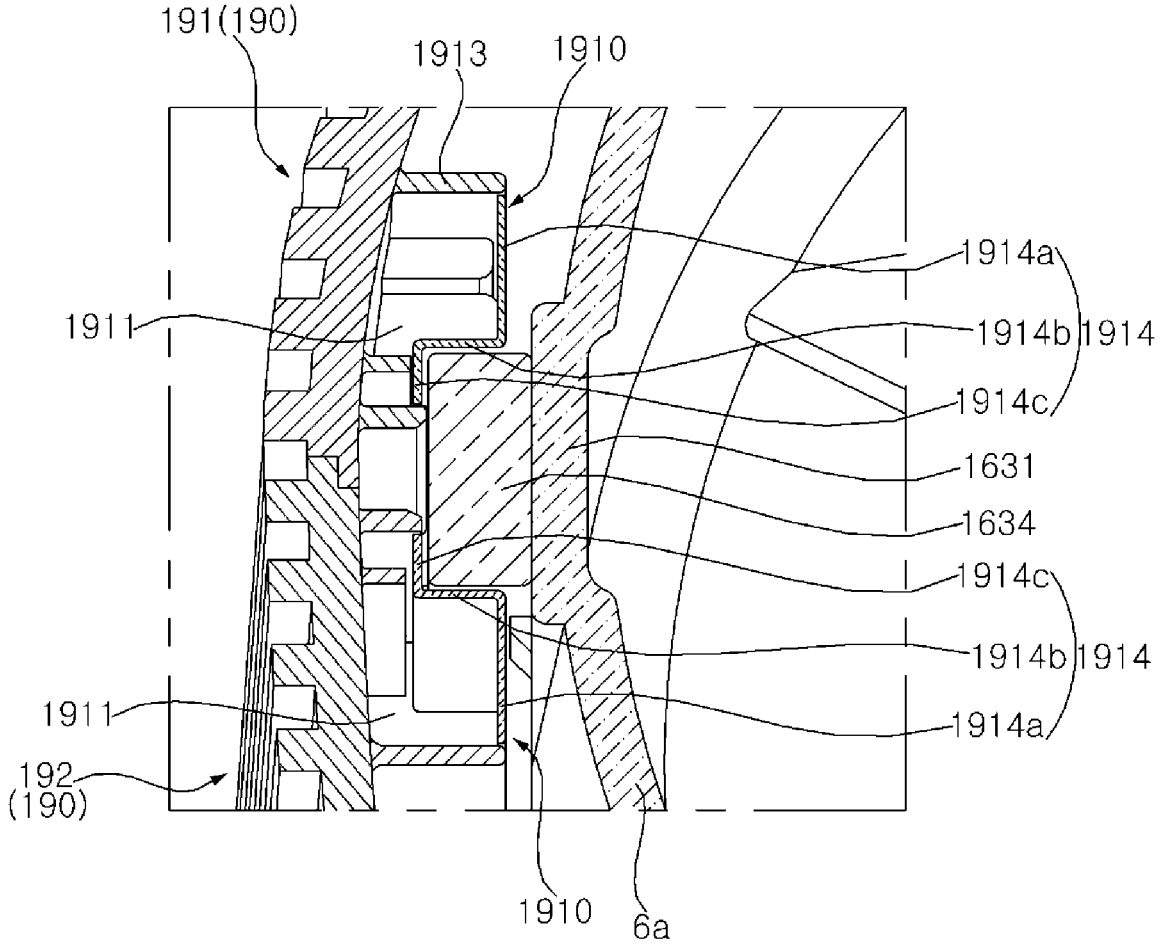
FIG. 20 is a view for explaining the coupling of the upper protrusion to an upper coupling portion according to an embodiment of the present disclosure.

1914*c* (refer to FIG. 20). The first upper part 1914*a* may form a front end of the upper plate 1914 and may extend in the front-rear direction. The second upper part 1914*b* may be perpendicular to the first upper part 1914*a*. The third upper part 1914*c* may be perpendicular to the second upper part 1914*b* and may extend in the front-rear direction.

Meanwhile, a gap d10 between the inner surface of the first case 191 and the upper block 1911 may be smaller than a gap d30 between the inner surface of the first case 191 and the lower block 1931. In this case, the gap d10 may be 0 or greater than 0.

The locking portion 1920 may be provided on the inner surface of the first case 191. The locking portion 1920 may be adjacent to the rear end of the first case 191, and the locking portion 1920 may be located in the lower side of the upper protrusion 1910. The locking portion 1920 may include a first locking portion 1920*a* and a second locking portion 1920*b* that are spaced apart from each other in the circumferential direction of the first case 191. For example, the first locking portion 1920*a* and the second locking portion 1920*b* may be symmetrical left and right. In this case, the description of the first locking portion 1920*a* may be identically applied to the second locking portion 1920*b*. The first locking portion 1920*a* may include a protruding rib 1921 and a protrusion 1922.

The protruding rib 1921 may protrude from the inner surface of the first case 191 and may extend along the up-down direction. The protrusion 1922 may protrude in the rearward direction from the upper end of the protruding rib 1921, and may be spaced apart from the inner surface of the first case 191.

Figure 19:
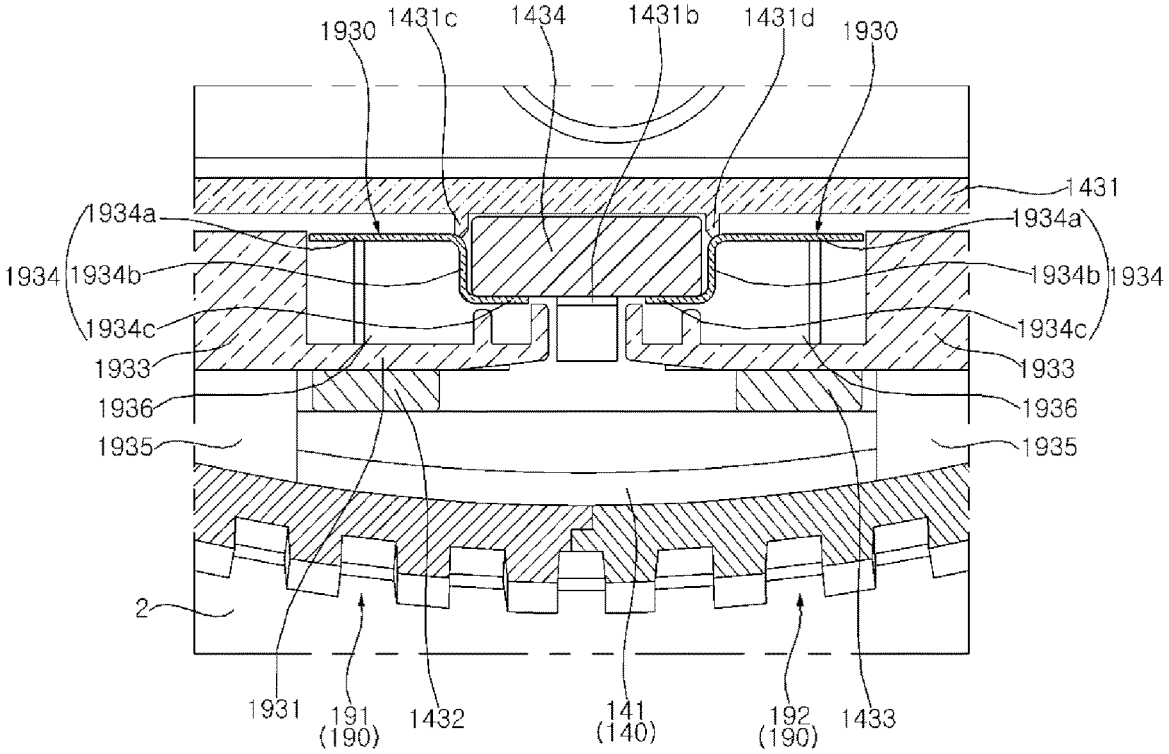
FIG. 19 is a view for explaining the coupling of the lower protrusion to a lower coupling portion according to an embodiment of the present disclosure.

Referring to FIGS. 12 and 19, the lower protrusion 1930 of the first case 191 may be inserted between the first insertion portion 1432 and the lower seating portion 1431. In this case, the lower protrusion 1930 may be located in the first slot 1432*s*, and the support rib 1935 may be located in the first groove 1432*g*. The lower plate 1934 of the lower protrusion 1930 may be magnetically coupled to the lower magnet 1434.

The lower protrusion 1930 of the second case 192 may be inserted between the second insertion portion 1433 and the lower seating portion 1431. In this case, the lower protrusion 1930 may be located in the second slot 1433*s*, and the support rib 1935 may be located in the second groove 1433*g*. The lower plate 1934 of the lower protrusion 1930 may be magnetically coupled to the lower magnet 1434.

Accordingly, the first case 191 and the second case 192 may move in the horizontal direction and may be coupled to or separated from the lower coupling portion 143, 144 (refer to FIG. 11).

Referring to FIGS. 12 and 20, the upper protrusion 1910 of the first case 191 may contact the upper magnet 1634. In this case, the upper plate 1914 of the upper protrusion 1910 may be magnetically coupled to the upper magnet 1634. At this time, the protrusion 1922 (refer to FIG. 18) of the first case 191 may be inserted into the upper slot 1632*s*, and may be caught on the upper insertion portion 1632.

The upper protrusion 1910 of the second case 192 may contact the upper magnet 1634. In this case, the upper plate 1914 of the upper protrusion 1910 may be magnetically coupled to the upper magnet 1634. At this time, the protrusion of the second case 192 may be inserted into the upper slot 1632*s*, and may be caught on the upper insertion portion 1632.

Accordingly, the first case 191 and the second case 192 may move in the horizontal direction and may be coupled to or separated from the upper coupling portion 163, 164 (refer to FIG. 11). Such a process of coupling and separating the case 191 and 192 may not be interfered with by the outer panel 122 and 123 located in the upper side of the lower panel 123, 223.

In addition, the distal end of the first case 191 and the distal end of the second case 192 may contact each other. The case 191 and 192 may be smoothly connected to the outer panel 122 and 123 (refer to FIG. 1).

Referring back to FIGS. 11 and 18, a plurality of inner holes 142*a* may be formed to penetrate the side surface of the body 142 of the housing 140. The plurality of inner holes 142*a* may be formed in the front portion of the body 142. Alternatively, the plurality of inner holes 142*a* may be formed in the front portion and the rear portion of the body 142.

A plurality of outer holes 191*b* may be formed to penetrate the first case 191 and/or the second case 192 (refer to FIG. 13). The plurality of outer holes 191*b* may be located in the lower side of the suction holes 3*a*. The plurality of outer holes 191*b* may face the plurality of inner holes 142*a*.

A first slit 142*b* may be formed to penetrate the side surface of the body 142. The first slit 142*b* may be formed in the front portion of the body 142. For example, the first slit 142*b* may be located in the lower side of the plurality of inner holes 142*a*. For example, the slit 142*b* may be a pair of first slits 142*b* spaced apart from each other in the circumferential direction of the body 142.

A second slit 150*cb* (refer to FIG. 22) may be formed to penetrate the side surface of the body 142. The second slit 150*cb* may be formed in the rear portion of the body 142. For example, a third column 150*c* may form a portion of the body 142, and the second slit 150*cb* may be formed to penetrate the side surface of the third column 150*c*. For example, the second slit 150*cb* may be a pair of second slits 150*cb* spaced apart from each other in the circumferential direction of the body 142.

Figure 21:
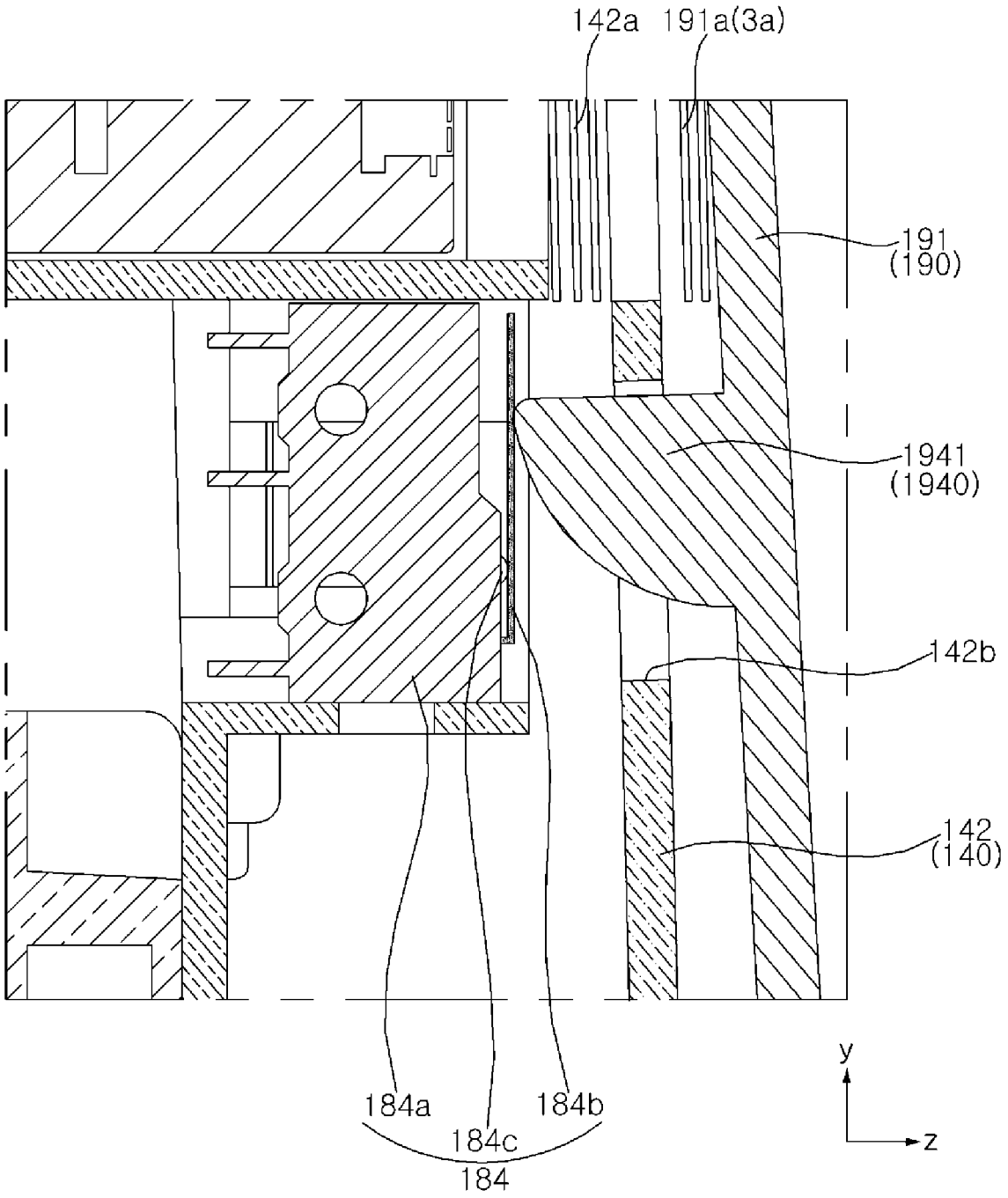
FIG. 21 is a view for explaining a structure in which a first horizontal protrusion turns on a first switch according to an embodiment of the present disclosure.

Referring to FIGS. 18 and 21, a first horizontal protrusion 1941 of the first case 191 may protrude in the rearward direction from the inner surface of the first case 191. The first horizontal protrusion 1941 may face the first slit 142*b* formed in the front portion of the body 142. For example, the first horizontal protrusion 1941 may be a pair of first horizontal protrusions 1941 spaced apart from each other in the circumferential direction of the first case 191.

A first switch 184 may be located inside the body 142 and may be adjacent to the first slit 142*b*. The first switch 184 may be electrically connected to the board 180 (refer to FIG. 23). The first switch 184 may be referred to as a first side switch. For example, the first switch 184 may be a micro switch. The first switch 184 may include a first switch body 184*a*, a first lever 184*b*, and a first button 184*c*.

One side of the first switch body 184*a* may face the first slit 142*b*. A common terminal, a normally open (NO) terminal, and a normally closed (NC) terminal may be provided in the other side of the first switch body 184*a*. A first lever 184*b* may have elasticity. The first lever 184*b* may be located between the first switch body 184*a* and the first slit 142*b*, and one end of the first lever 184*b* may be fixed to the one side of the first switch body 184*a*. A remaining portion excluding the one end of the first lever 184*b* may be spaced apart from the one side of the first switch body 184*a*. The first button 184*c* may be located between the first switch body 184*a* and the first lever 184*b*, and may be provided in the one side of the first switch body 184*a*. The first button 184*c* may be connected to an elastic member provided inside the first switch body 184*a*, and may be referred to as a first plunger.

When the first case 191 is coupled to the body 142, the distal end of the first horizontal protrusion 1941 may move the first lever 184*b* toward the first switch body 184*a*. At this time, the first lever 184*b* may press the first button 184*c*.

When the first case 191 is separated from the body 142, the distal end of the first horizontal protrusion 1941 may be spaced apart from the first lever 184*b*. In this case, the pressing of the first button 184*c* may be released, and the first button 184*c* may move the first lever 184*b* in a direction away from the first switch body 184*a*.

Accordingly, the first switch 184 may be turned on when the first case 191 is coupled to the housing 140, and turned off when the first case 191 is separated from the housing 140.

Figure 22:
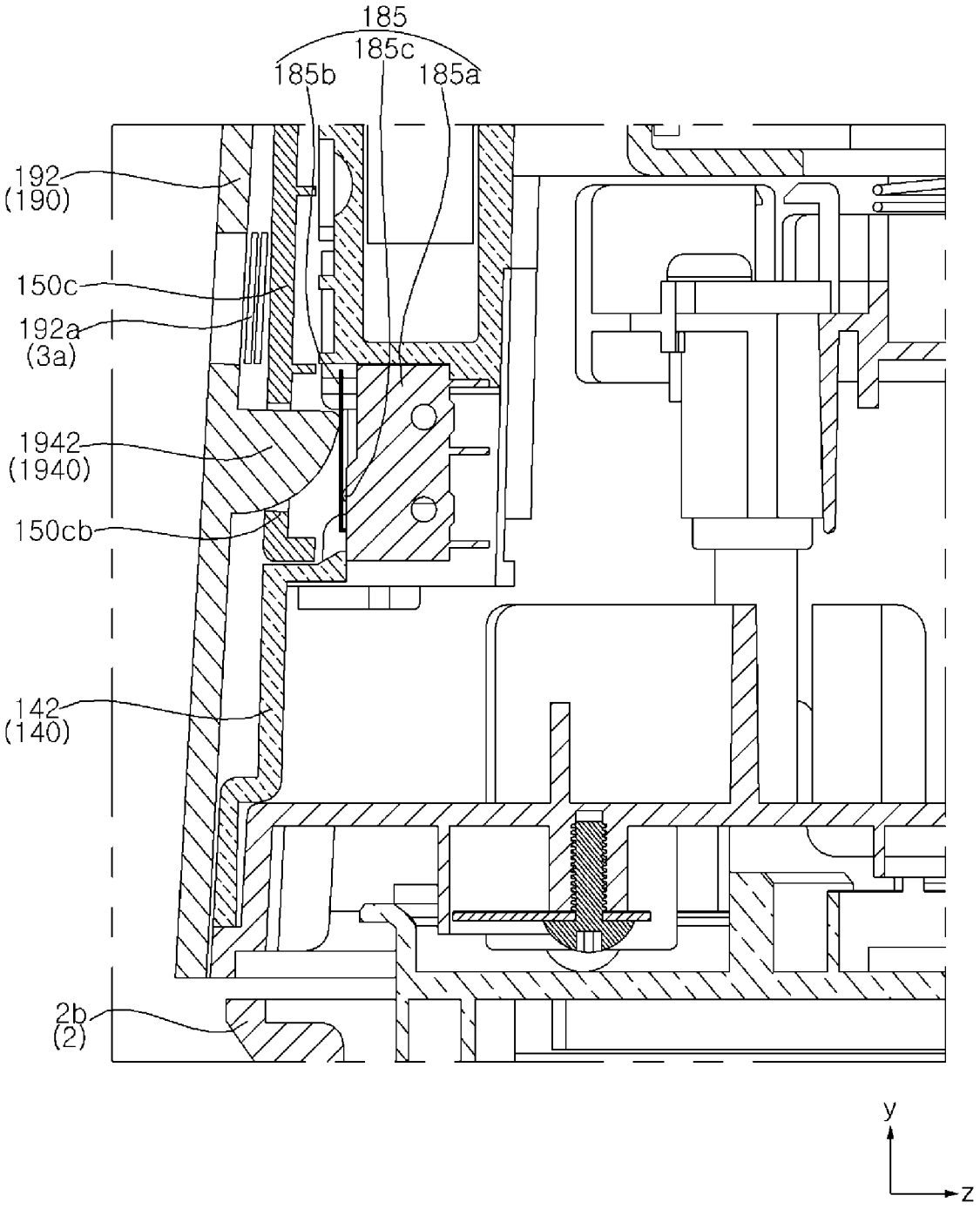
FIG. 22 is a view for explaining a structure in which a second horizontal protrusion turns on a second switch according to an embodiment of the present disclosure.

Referring to FIGS. 13 and 22, the second horizontal protrusion 1942 of the second case 192 may protrude in the forward direction from the inner surface of the second case 192. The second horizontal protrusion 1942 may face the second slit 150*cb* formed in the rear portion of the body 142. For example, the second horizontal protrusion 1942 may be a pair of second horizontal protrusions 1942 spaced apart from each other in the circumferential direction of the second case 192.

The second switch 185 may be located inside the body 142 and may be adjacent to the second slit 150*cb*. The second switch 185 may be electrically connected to the board 180 (refer to FIG. 23). The second switch 185 may be referred to as a second side switch. For example, the second switch 185 may be a micro switch. The second switch 185 may include a second switch body 185*a*, a second lever 185*b*, and a second button 185*c*.

One side of the second switch body 185*a* may face the second slit 150*cb*. A common terminal, a normally open (NO) terminal, and a normally closed (NC) terminal may be provided in the other side of the second switch body 185*a*. The second lever 185*b* may have elasticity. The second lever 185*b* may be located between the second switch body 185*a* and the second slit 150*cb*, and one end of the second lever 185*b* may be fixed to the one side of the second switch body 185*a*. A remaining portion excluding the one end of the second lever 185*b* may be spaced apart from the one side of the second switch body 185*a*. The second button 185*c* may be located between the second switch body 185*a* and the second lever 185*b*, and may be provided in the one side of the second switch body 185*a*. The second button 185*c* may be connected to an elastic member provided inside the second switch body 185*a*, and may be referred to as a second plunger.

When the second case 192 is coupled to the body 142, the distal end of the second horizontal protrusion 1942 may move the second lever 185*b* toward the second switch body 185*a*. At this time, the second lever 185*b* may press the second button 185*c*.

When the second case 192 is separated from the body 142, the distal end of the second horizontal protrusion 1942 may be spaced apart from the second lever 185*b*. In this case, the pressing of the second button 185*c* may be released, and the second button 185*c* may move the second lever 185*b* in a direction away from the second switch body 185*a*.

Accordingly, the second switch 185 may be turned on when the second case 192 is coupled to the housing 140, and turned off when the second case 192 is separated from the housing 140.

Figure 23:
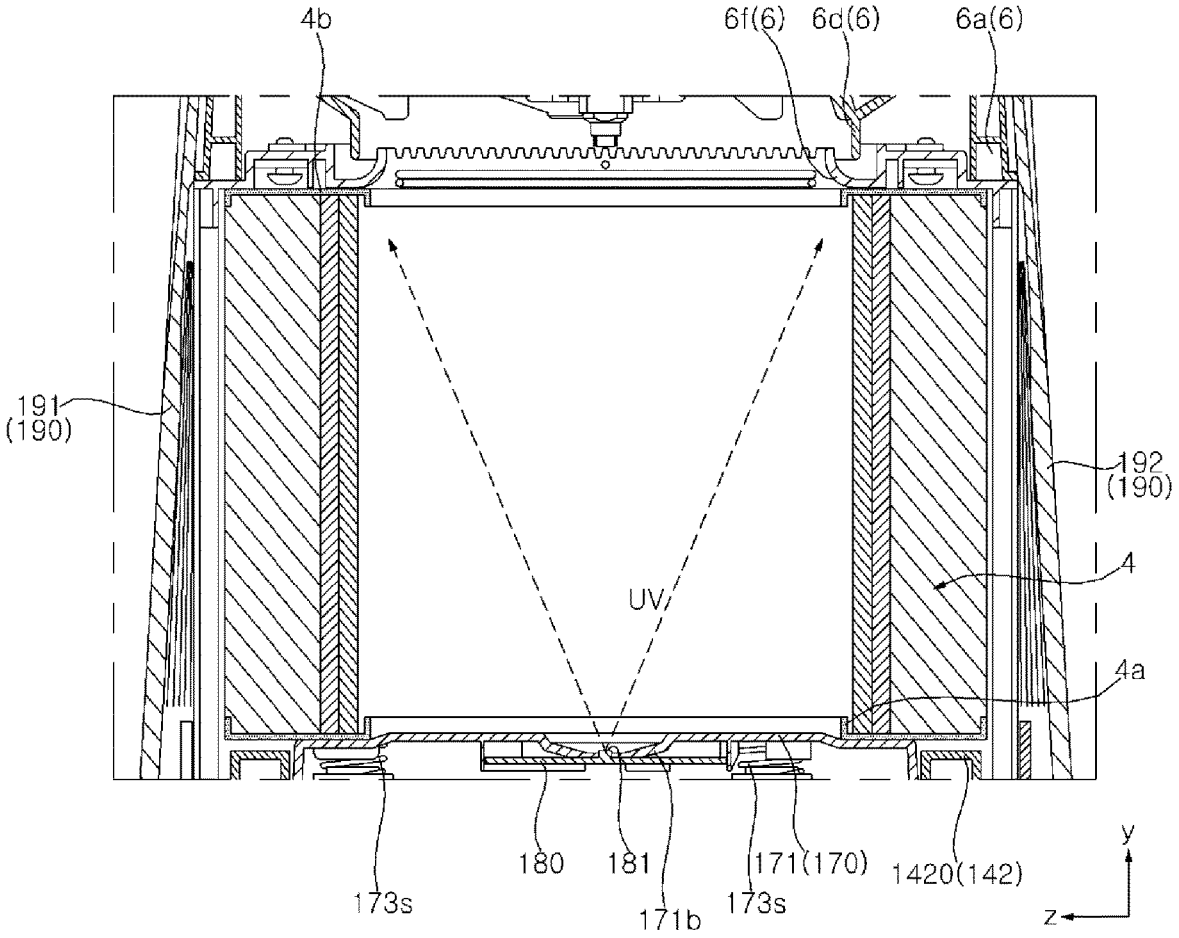
FIG. 23 is a view for explaining a structure in which a light source provides light in an ultraviolet wavelength band to a fan according to a first embodiment of the present disclosure.

Referring to FIG. 23, the light source 181 may be mounted on the board 180. The light source 181 may be located in a hole 171*a* (refer to FIG. 14) formed in the recession portion 171*b* of the seating portion 171. That is, the upper end of the light source 181 may be located in the lower side of the upper surface of the seating portion 171. Accordingly, it is possible to prevent damage to the light source 181 by the lower frame 4*a* of the filter 4 in a process of assembling the filter 4 with respect to the seating portion 171 described above with reference to FIG. 13, and the like.

In addition, the light source 181 may provide light to the fan 6. For example, the light of the light source 181 may reach the inner circumferential surface of the bell mouth 6*f*, i.e., a suction port of the fan 60. For example, the light source 181 may provide light in an ultraviolet wavelength band. For example, the light source 181 may be a UVC LED or a UVC lamp providing light having a wavelength of 100 to 280 nm. Accordingly, the light of the light source 181 may sterilize bacteria or microorganisms existing in the fan 6 or in the air passing through the fan 6. In addition, the light of the light source 181 may sterilize bacteria or microorganisms existing in the filter 4 or in the air that has passed through the filter 4.

A controller (not shown) may control the operation of the light source 181. Here, the light source 181 provides light when operated. For example, the controller may be mounted in the board 180, and may be electrically connected to the board 180 and the light source 181. For another example, the controller may be located inside the housing 140, may be spaced apart from the board 180, and may be electrically connected to the board 180 and the light source 181. In this case, the controller may detect an on-off of the top switch 183 (refer to FIG. 17), the first switch 184 (refer to FIG. 21), and the second switch 185 (refer to FIG. 22).

In addition, when at least one of the top switch 183, the first switch 184, and the second switch 185 is in an off state, the controller may stop the operation of the light source 181. That is, when the first case 191 is separated from the housing 140, the second case 192 is separated from the housing 140, or the filter 4 is separated from the supporter 170, the controller may stop the operation of the light source 181.

In addition, when the top switch 183, the first switch 184, and the second switch 185 are all in an on state, the controller may operate the light source 181. That is, when the filter 4 is seated in the supporter 170 and the first case 191 and the second case 192 are coupled to the housing 140, the controller may operate the light source 181.

Accordingly, the controller may sterilize the fan 6 by operating the light source 181 when the light of the light source 181 can be blocked from being leaked to the outside by the filter 4 and the case 191 and 192. In other words, the controller may stop the operation of the light source 181 when the filter 4 or the case 191 and 192 is separated from the blower to fundamentally block the leaking of light.

Meanwhile, the photocatalyst may be coated on the filter 4. The photocatalyst may be activated by the light of the light source 181 and may decompose harmful substances in the air through a photochemical reaction. In this case, the light source 181 may further include a UVA LED or UVA lamp providing light having a wavelength of 315 to 400 nm, and may activate the photocatalyst. The photocatalyst may include tungsten oxide, titanium oxide, zinc oxide, or zirconium oxide. For example, a co-catalyst may be coated on the filter 4 and may help to activate the photo-catalyst. The co-catalyst may include platinum Pt, rhodium Rh, ruthenium Ru, palladium Pd, silver Ag, copper Cu, or zinc Zn. Accordingly, the filter 4 may have a photo-decomposition effect of harmful substances.

Figure 24:
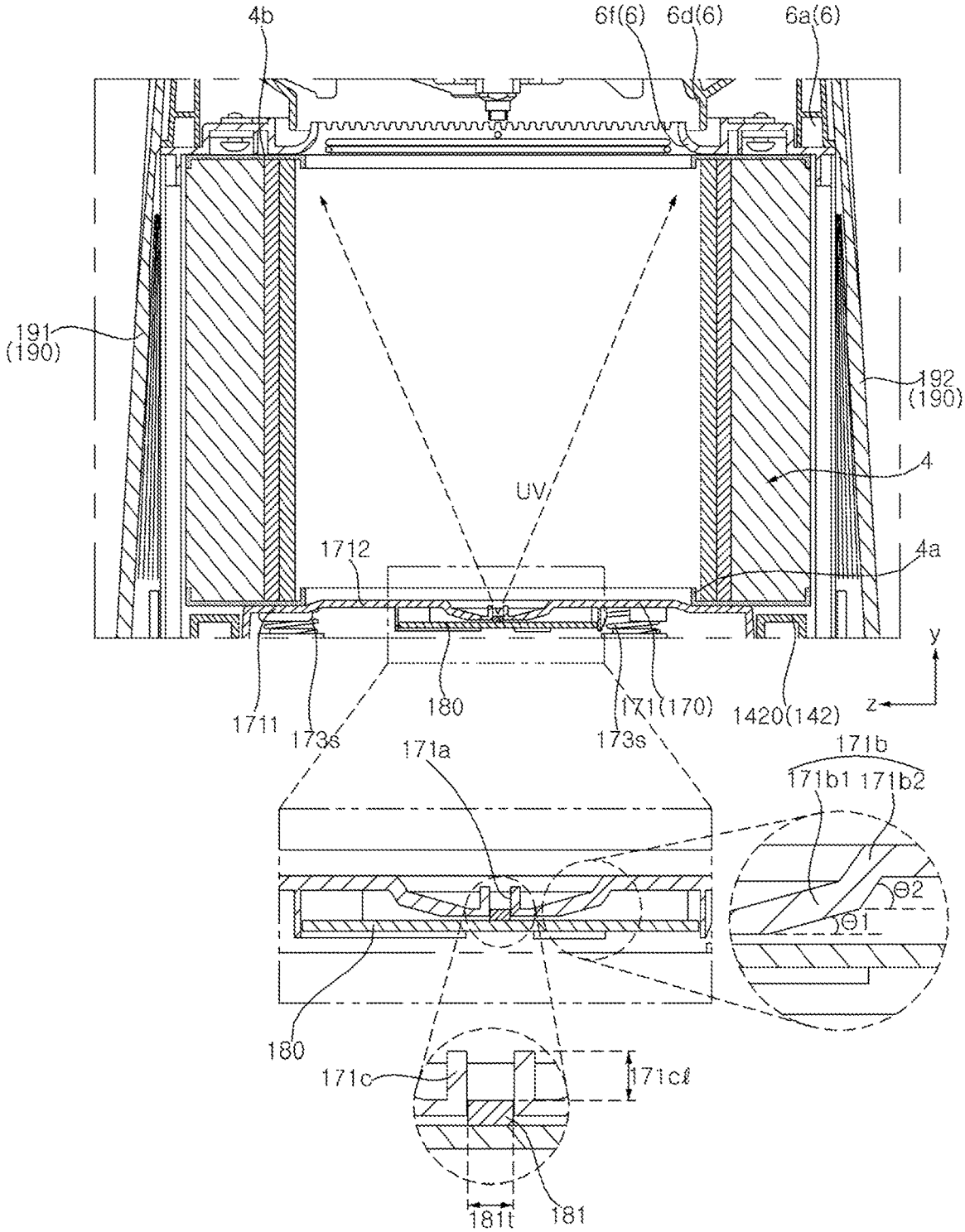
FIG. 24 is a view for explaining a structure in which a light source provides light in an ultraviolet wavelength band to a fan according to a second embodiment of the present disclosure.
Figure 25:
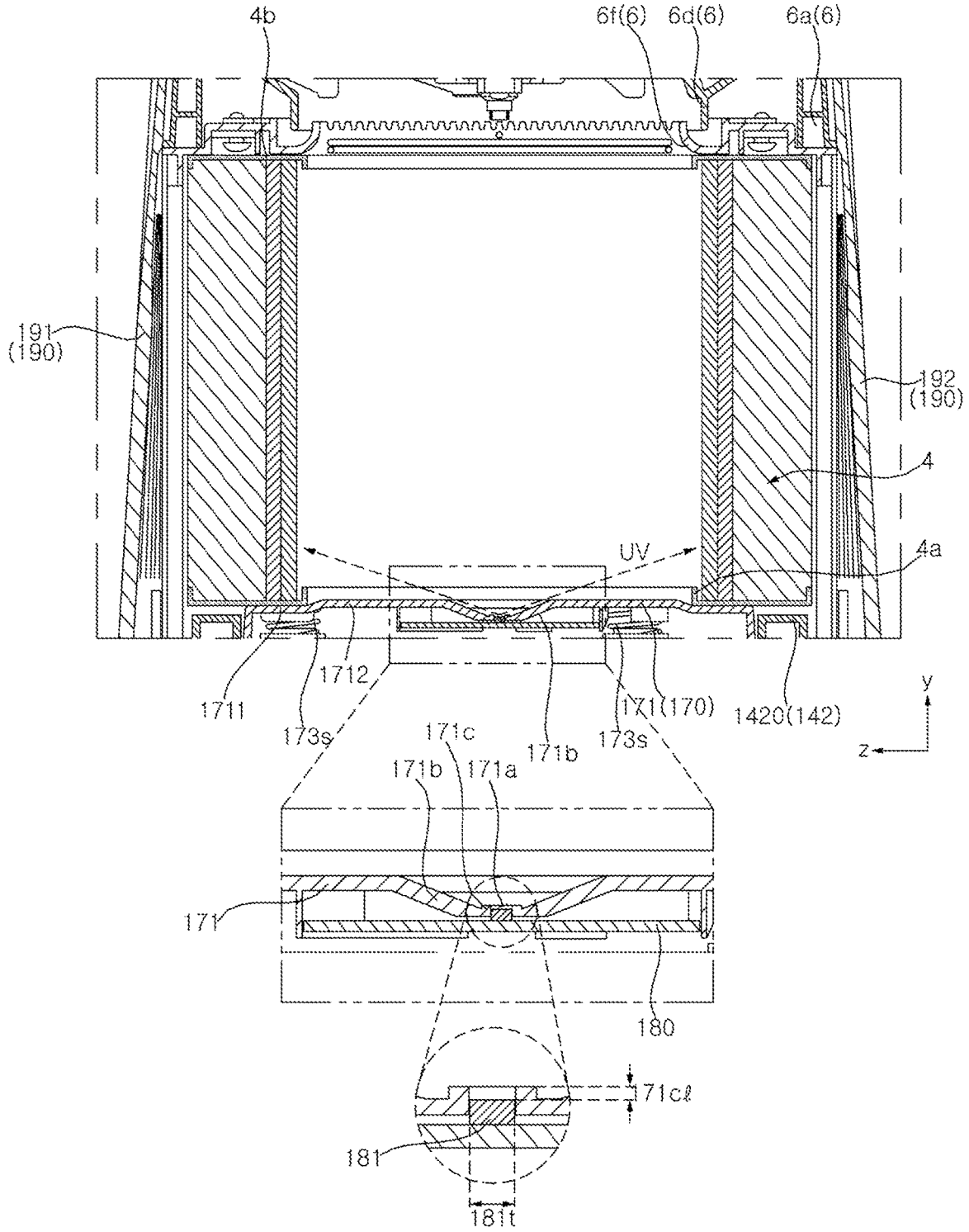
FIG. 25 is a view for explaining a structure in which a light source provides light in an ultraviolet wavelength band to a fan according to a third embodiment of the present disclosure.

Referring to FIGS. 23 to 25, the lower frame 4*a* of the filter 4 may be located on a first portion 1711 of the upper surface of the seating portion 171. The first portion 1711 may be a portion adjacent to an edge of the seating portion 171. A second portion 1712 of the upper surface of the seating portion 171 may protrude more upward than the first portion 1711. The second portion 1712 may be a portion located in the inner side of the lower frame 4*a*, and may face a hollow space of the filter 4.

The recession portion 171*b* may be formed in a central portion of the second portion 1712. The maximum depth of the recession portion 171*b* may be defined at the center of the recession portion 171*b*. The recession portion 171*b* may have a puddle shape as a whole. The bottom of the recession portion 171*b* may be located on or adjacent to the board 180, and may be disposed in parallel with the board 180. A lateral side of the recession portion 171*b* may extend to be inclined from the bottom of the recession portion 171*b* to the second portion 1712 of the seating portion 171 (refer to FIG. 25). In this case, the lateral side of the recession portion 171*b* may be located in the light path of the light source 181. Alternatively, the lateral side of the recession portion 171*b* may include a first side 171*b*1 and a second side 171*b*2 having a different inclination angle (refer to FIG. 24). The first side 171*b*1 may be connected to the bottom of the recession portion 171*b*, and may be inclined by a first angle θ1 from the bottom. The second side 171*b*2 may be connected to the first side 171*b*1 and the second portion 1712 of the seating portion 171, and may be inclined by a second angle θ2 greater than the first angle θ1 from the bottom. The first angle θ1 may be an angle at which the first side 171*b*1 is located to deviate from the light path of the light source 181.

Referring to FIG. 23, the light source 181 may be located in the hole 171*a* (refer to FIG. 14) of the recession portion 171*b*. The light source 181 may provide light to the fan 6 and/or filter 4 corresponding to its own irradiation angle. Alternatively, the lateral side of the recession portion 171*b* may be located in a light path of the light source 181 to restrict the irradiation range of the light source 181.

Referring to FIGS. 24 and 25, the light source 181 may be located in the hole 171*a* of the recession portion 171*b*, and the rib 171*c* may be located in the light path of the light source 181. The rib 171*c* may adjust the light path and protect the light source 181. The rib 171*c* may be referred to as a light guide or a shield.

The rib 171*c* may protrude from the recession portion 171*b* toward the fan 6 and may extend along the circumference of the light source 181. The inner side of the rib 171*c* may be in contact with or adjacent to the circumference of the light source 181. The rib 171*c* may have a shape corresponding to the cross-section of the light source 181. When the cross-section of the light source 181 is circular, the rib 171*c* may have a hollow cylinder shape. When the cross-section of the light source 181 is quadrangular, the rib 171*c* may have a hollow square barrel shape. The central axis of the rib 171*c* may be parallel to the vertical direction. The inner side of the rib 171*c* may define a boundary of the hole 171*a* of the recession portion 171*b*.

Referring to FIG. 24, for example, a length 171*c*1 of the rib 171*c* protruding upward from the upper end of the light source 181 may be greater than a diameter 181*t* or a width 181*t* of the light source 181. In addition, the upper end of the rib 171*c* may be located higher than the first side 171*b*1. The length 171*c*1 may be referred to as a protrusion height 171*c*1. The rib 171*c* may be located in a light path of the light source 181. The rib 171*c* may adjust the light path of the light source 181 so that the light of the light source 181 can be intensively irradiated to the fan 6 (refer to a dotted arrow in FIG. 24). That is, the irradiation range of the light source 181 may be restricted by the rib 171*c*.

Accordingly, the rib 171*c* may minimize the light of the light source 181 from being provided to the outside of the filter 4 or the case 190. Meanwhile, in some embodiment, regardless of whether the filter 4 is mounted in the blower (i.e. even when the filter 4 is not mounted in the blower), it is possible to minimize the light of the light source 181 in operation from leaking to the outside through the suction hole 3*a* (refer to FIG. 13) of the case 190.

For another example with reference to FIG. 25, the length 171*c*1 of the rib 171*c* protruding upward from the upper end of the light source 181 may be substantially equal to or smaller than the diameter 181*t* or the width 181*t* of the light source 181. In addition, the upper end of the rib 171*c* may be located closer to the bottom than the top of the recession portion 171*b*, and the light path of the light source 181 may be more affected by the lateral side of the recession portion 171*b* than the rib 171*c*. The length 171*c*1 may be referred to as a protrusion height 171*c*1. The rib 171*c* may be located in the light path of the light source 181.

Accordingly, the rib 171*c* may adjust the light path of the light source 181 so that the light of the light source 181 may be irradiated to the fan 6 and the filter 4. In addition, the rib 171*c* may restrict the irradiation range of light so that the light of the light source 181 can be provided upward of the lower frame 4*a* by the recession portion 171*b* (refer to a dotted arrow in FIG. 25). That is, the lateral side of the recession portion 171*b* may be located in the light path of the light source 181 adjusted by the rib 171*c*. In this case, the sterilization rate of the fan 6 and the filter 4 by the light of the light source 181 may be increased.

Referring to FIGS. 1 to 25, a blower according to an aspect of the present disclosure may include: a fan configured to generate a flow of air; a filter positioned upstream of the fan; a case covering a side surface of the filter and having a suction hole; a housing which is positioned opposite to the fan with respect to the filter, and to which the case is detachably coupled; a supporter coupled to one surface of the housing facing the filter and configured to support the filter; a light source disposed at the supporter and configured to provide light in an ultraviolet wavelength band to the fan; and a controller configured to control an operation of the light source, wherein when the case is separated from the housing or when the filter is separated from the supporter, the controller may stop the operation of the light source.

The case may further include: a first case detachably coupled to the housing; and a second case which is positioned opposite to the first case with respect to the housing, and which is detachably coupled to the housing, wherein the controller may stop the operation of the light source, when at least one of the first case or the second case is separated from the housing.

The blower may further include: a first switch positioned inside the housing, electrically connected to the controller, turned on when the first case is coupled to the housing, and turned off when the first case is separated from the housing; and a second switch positioned inside the housing, electrically connected to the controller, turned on when the second case is coupled to the housing, and turned off when the second case is separated from the housing, wherein the controller may stop the operation of the light source, when at least one of the first switch or the second switch is turned off, based on on-off information of the first switch and the second switch.

The housing may further include: a first slit formed to penetrate a side surface of the housing, facing an inner surface of the first case, and adjacent to the first switch; and a second slit formed to penetrate the side surface of the housing, facing an inner surface of the second case, and is adjacent to the second switch, wherein the first case may further include a first horizontal protrusion protruding from the inner surface of the first case, penetrating the first slit, and contacting the first switch, and wherein the second case may further include a second horizontal protrusion protruding from the inner surface of the second case, penetrating the second slit, and contacting the second switch.

The first switch may further includes: a first switch body having one side that faces the first slit; a first lever positioned between the first switch body and the first horizontal protrusion, and having one end fixed to the one side of the first switch body; and a first button provided in the one side of the first switch body between the first switch body and the first lever, wherein the first switch may be turned on when the first button is pressed by the first lever, and may be turned off when a pressing of the first button is released.

The first case and the second case may be detachably coupled to the housing in a horizontal direction.

The first case may be convex in a first direction, and the second case may be convex in a second direction opposite to the first direction, wherein the housing may further include: a first lower coupling portion formed at one side of the housing, and positioned in a boundary between the first case and the second case; and a second lower coupling portion formed at the other side of the housing, and positioned in the boundary between the first case and the second case, wherein the first case and the second case may be detachably coupled to the first lower coupling portion and the second lower coupling portion.

The blower may further include a top switch positioned inside the housing, electrically connected to the controller, turned on when the filter is seated on the supporter, and turned off when the filter is separated from the supporter, wherein the controller may stop the operation of the light source, when the top switch is off, based on on-off information of the top switch.

The housing may further includes a groove which is formed while being recessed from the one surface of the housing, and which has an opening, wherein the supporter may be coupled to the groove on the groove, and covers the opening, wherein the top switch may be positioned opposite to the supporter with respect to the groove, and is coupled to the groove, wherein the supporter may further includes a vertical protrusion protruding from the supporter, penetrating the groove, and contacting the top switch.

The top switch may further include: a switch body having one side that faces the vertical protrusion; a lever positioned between the switch body and the vertical protrusion, and having one end fixed to the one side of the switch body; and a button which is provided in the one side of the switch body between the switch body and the lever, wherein the top switch may be turned on when the button is pressed by the lever, and may be turned off when a pressing of the button is released.

The blower may further includes an elastic member fixed to the supporter and the groove between the supporter and the groove, wherein a compression of the elastic member may be restricted by contact between the supporter and the groove.

The supporter may further include: a plurality of coupling portions protruding from the supporter toward the groove; a plurality of coupling holes through which the plurality of coupling portions pass; and a plurality of fastening members fastened to the plurality of coupling portions, wherein a diameter of the fastening member may be larger than a diameter of the coupling hole blower.

The supporter may further include a recession portion which is formed while being recessed from one surface of the supporter facing the filter, and which has a hole at which the light source is located, and the blower may further include a board which is coupled to an inner surface of the recession portion, which is positioned above the opening, and on which the light source is mounted.

The light source may provide light having a wavelength ranging from 100 to 280 nm.

The blower may further include an upper body which is located downstream of the fan, and at which a discharge hole is formed, wherein the upper body may include: a first upper body; a second upper body spaced apart from the first upper body; and a space formed between the first upper body and the second upper body, wherein the discharge hole may be formed on one surface facing the space of each of the first upper body and the second upper body.

A blower according to another aspect of the present disclosure may include: a fan for generating a flow of air; a filter located upstream of the fan; a supporter is opposite to the fan with respect to the filter; a light source which is located in the supporter, and provides light in an ultraviolet wavelength band to the fan; and a rib that protrudes from the supporter toward the fan, extends along a circumference of the light source, and is located in a light path of the light source.

The effect of the blower according to the present disclosure will be described as follows.

According to at least one of the embodiments of the present disclosure, it is possible to provide a blower capable of sterilizing a fan that causes the flow of air.

According to at least one of the embodiments of the present disclosure, it is possible to provide a structure capable of providing light in an ultraviolet wavelength band to a fan.

According to at least one of the embodiments of the present disclosure, it is possible to provide a structure and method capable of preventing ultraviolet rays from leaking to the outside.

According to at least one of the embodiments of the present disclosure, it is possible to provide a structure in which a user can easily mount or detach a case or filter in or from the blower.

According to at least one of the embodiments of the present disclosure, it is possible to provide a structure capable of preventing damage to a light source in the process of assembling or separating a filter.

According to at least one of the embodiments of the present disclosure, it is possible to provide a blower capable of sterilizing a filter as well as a fan, or imparting a photolysis effect to the filter.

According to at least one of the embodiments of the present disclosure, it is possible to provide various examples of a structure for guiding the light of a light source provided to sterilize a fan and/or a filter.

Certain embodiments or other embodiments of the invention described above are not mutually exclusive or distinct from each other. Any or all elements of the embodiments of the invention described above may be combined or combined with each other in configuration or function.

For example, a configuration "A" described in one embodiment of the invention and the drawings and a configuration "B" described in another embodiment of the invention and the drawings may be combined with each other. Namely, although the combination between the configurations is not directly described, the combination is possible except in the case where it is described that the combination is impossible.

An object of the present disclosure is to solve the above and other problems.

Another object may be to provide a blower capable of sterilizing a fan that causes the flow of air.

Another object may be to provide a structure capable of providing light in an ultraviolet wavelength band to a fan.

Another object may be to provide a structure and method capable of preventing ultraviolet rays from leaking to the outside.

Another object may be to provide a structure in which a user can easily mount or detach a case or filter in or from the blower.

Another object may be to provide a structure capable of preventing damage to a light source in the process of assembling or separating a filter.

Another object may be to provide a blower capable of sterilizing a filter as well as a fan, or imparting a photolysis effect to the filter.

Photolysis various examples of a structure for guiding the light of a light source provided to sterilize a fan and/or a filter.

In accordance with an aspect of the present invention, a blower includes: a fan configured to generate a flow of air; a filter positioned upstream of the fan; a case covering a side surface of the filter and having a suction hole; a housing which is positioned opposite to the fan with respect to the filter, and to which the case is detachably coupled; a supporter coupled to one surface of the housing facing the filter and configured to support the filter; a light source disposed at the supporter and configured to provide light in an ultraviolet wavelength band to the fan; and a controller configured to control an operation of the light source, wherein the controller stops the operation of the light source when the case is separated from the housing or when the filter is separated from the supporter.

Although embodiments have been described with reference to a number of illustrative embodiments thereof, it should be understood that numerous other modifications and embodiments can be devised by those skilled in the art that will fall within the scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

It will be understood that when an element or layer is referred to as being "on" another element or layer, the element or layer can be directly on another element or layer or intervening elements or layers. In contrast, when an element is referred to as being "directly on" another element or layer, there are no intervening elements or layers present. As used herein, the term "and/or" includes any and all combinations of one or more of the associated listed items.

It will be understood that, although the terms first, second, third, etc., may be used herein to describe various elements, components, regions, layers and/or sections, these elements, components, regions, layers and/or sections should not be limited by these terms. These terms are only used to distinguish one element, component, region, layer or section from another region, layer or section. Thus, a first element, component, region, layer or section could be termed a second element, component, region, layer or section without departing from the teachings of the present invention.

Spatially relative terms, such as "lower", "upper" and the like, may be used herein for ease of description to describe the relationship of one element or feature to another element(s) or feature(s) as illustrated in the figures. It will be understood that the spatially relative terms are intended to encompass different orientations of the device in use or operation, in addition to the orientation depicted in the figures. For example, if the device in the figures is turned over, elements described as "lower" relative to other elements or features would then be oriented "upper" relative to the other elements or features. Thus, the exemplary term "lower" can encompass both an orientation of above and below. The device may be otherwise oriented (rotated 90 degrees or at other orientations) and the spatially relative descriptors used herein interpreted accordingly.

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

Embodiments are described herein with reference to cross-section illustrations that are schematic illustrations of idealized embodiments (and intermediate structures). As such, variations from the shapes of the illustrations as a result, for example, of manufacturing techniques and/or tolerances, are to be expected. Thus, embodiments should not be construed as limited to the particular shapes of regions illustrated herein but are to include deviations in shapes that result, for example, from manufacturing.

Unless otherwise defined, all terms (including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of the relevant art and will not be interpreted in an idealized or overly formal sense unless expressly so defined herein.

Any reference in this specification to "one embodiment," "an embodiment," "example embodiment," etc., means that a particular feature, structure, or characteristic described in connection with the embodiment is included in at least one embodiment. The appearances of such phrases in various places in the specification are not necessarily all referring to the same embodiment. Further, when a particular feature, structure, or characteristic is described in connection with any embodiment, it is submitted that it is within the purview of one skilled in the art to effect such feature, structure, or characteristic in connection with other ones of the embodiments.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. A blower, comprising:

a fan configured to generate a flow of air;

a filter positioned upstream of the fan;

a case covering a side surface of the filter and having a suction hole;

a housing which is positioned opposite to the fan with respect to the filter and to which the case is detachably coupled;

a supporter tray coupled to one surface of the housing facing the filter and configured to support the filter;

a light source provided at the supporter tray and configured to provide ultraviolet (UV) light toward the fan; and a controller configured to manage the light source, wherein the controller deactivates the light source when the case is separated from the housing or when the filter is separated from the supporter tray.

2. The blower of claim 1, wherein the case includes:

a first case which is detachably coupled to the housing; and a second case which is positioned opposite to the first case with respect to the housing, and which is detachably coupled to the housing, wherein the controller deactivates the light source when at least one of the first case or the second case is separated from the housing.

3. The blower of claim 2, further comprising:

a first switch positioned inside the housing, electrically connected to the controller, and indicates to the controller whether the first case is coupled to the housing; and a second switch positioned inside the housing, electrically connected to the controller, and indicates to the controller whether the second case is coupled to the housing, wherein the controller deactivates the light source when at least one of the first switch or the second switch indicates to the controller that a respective one of first case or the second case is not coupled to the housing.

4. The blower of claim 3, wherein the housing includes:

a first slit formed to penetrate a side surface of the housing, provided to face an inner surface of the first case, and provided adjacent to the first switch; and a second slit formed to penetrate the side surface of the housing, provided to face an inner surface of the second case, and provided adjacent to the second switch, wherein the first case includes a first horizontal protrusion protruding from the inner surface of the first case, penetrating the first slit, and contacting the first switch when the first case is coupled to the housing, and wherein the second case includes a second horizontal protrusion protruding from the inner surface of the second case, penetrating the second slit, and contacting the second switch when the second case is coupled to the housing.

5. The blower of claim 4, wherein the first switch includes:

a first switch body having a side that faces the first slit;

a first lever positioned between the first switch body and the first horizontal protrusion, and having one end fixed to the side of the first switch body; and a first button provided in the side of the first switch body between the first switch body and the first lever, and wherein the first switch is turned on when the first button is pressed by the first lever and is turned off when the first button is not pressed by the first lever.

6. The blower of claim 4, wherein the first case and the second case are detachably coupled to the housing in a horizontal direction.

7. The blower of claim 6, wherein the first case is convex in a first direction, and the second case is convex in a second direction opposite to the first direction, wherein the housing includes:

a first lower coupler formed at one side of the housing, and positioned in a boundary between the first case and the second case; and a second lower coupler formed at the other side of the housing, and positioned in the boundary between the first case and the second case, and wherein the first case and the second case are detachably coupled to the first lower coupling portion and the second lower coupling portion.

8. The blower of claim 1, further comprising a top switch positioned inside the housing, electrically connected to the controller, and selectively activated based on whether the filter is seated on the supporter tray, wherein the controller deactivates the light source based on whether the top switch is activated.

9. The blower of claim 8, wherein the housing includes a groove which is formed on the one surface of the housing, and the groove has an opening, wherein the supporter tray is coupled to the groove and covers the opening, wherein the top switch is positioned opposite to the supporter tray with respect to the groove and is coupled to the groove, and wherein the supporter tray includes a vertical protrusion protruding from the supporter tray, and penetrating the opening of the groove and contacting the top switch.

10. The blower of claim 9, wherein the top switch includes:

a switch body having a side that faces the vertical protrusion;

a lever positioned between the switch body and the vertical protrusion, and having one end fixed to the side of the switch body; and a button which is provided in the side of the switch body between the switch body and the lever, and wherein the top switch is selectively turned on based on whether the button is pressed by the lever or the button is released.

11. The blower of claim 9, further comprising a spring fixed to the supporter tray and the groove between the supporter tray and the groove, and wherein a compression of the spring is restricted by contact between the supporter tray and the groove.

12. The blower of claim 9, wherein the supporter tray includes:

a plurality of coupling bosses protruding from the supporter tray toward the groove;

a plurality of coupling holes through which the plurality of coupling bosses pass; and a plurality of fasteners fastened to the plurality of coupling bosses, and wherein a diameter of one of the fasteners is greater than a diameter of one of the coupling holes.

13. The blower of claim 9, wherein the supporter tray includes:

a supporter recess which is formed on a surface of the supporter tray facing the filter, and which has a hole at which the light source is located, and a board which is coupled to an inner surface of the supporter recess, which is positioned above the opening, and on which the light source is mounted.

14. The blower of claim 1, wherein the light source provides UV light having a wavelength ranging from 100 to 280 nm.

15. The blower of claim 1, further comprising an upper body which is located downstream of the fan, wherein the upper body includes:

a first upper body; and a second upper body spaced apart from the first upper body, wherein a space is provided between the first upper body and the second upper body, and wherein the upper body includes discharge holes that are formed on respective surfaces of the first upper body and the second upper body facing the space.

16. A blower comprising:

a fan configured to generate a flow of air;

a filter positioned upstream of the fan;

a case covering a side surface of the filter and having a suction hole;

a housing which is positioned opposite to the fan with respect to the filter and to which the case is detachably coupled;

a supporter tray coupled to one surface of the housing facing the filter and configured to support the filter;

a light source provided at the supporter tray and configured to provide ultraviolet (UV) light toward the fan; and at least one switch configured to be deactivated when the case is separated from the housing or the filter is separated from the supporter tray, wherein the light source is deactivated when one or more of the at least one switch is deactivated.

17. The blower of claim 16, wherein the case includes:

a first case which is detachably coupled to the housing; and a second case which is positioned opposite to the first case with respect to the housing, and which is detachably coupled to the housing, and wherein the at least one switch includes:

a first switch that is deactivated when the first case is uncoupled from the housing; and a second switch that is deactivated when the second case is uncoupled from the housing.

18. The blower of claim 17, wherein the housing includes:

a first slit formed to penetrate a side surface of the housing, provided to face an inner surface of the first case, and provided adjacent to the first switch; and a second slit formed to penetrate the side surface of the housing, provided to face an inner surface of the second case, and provided adjacent to the second switch, wherein the first case includes a first horizontal protrusion protruding from the inner surface of the first case, penetrating the first slit, and contacting the first switch when the first case is coupled to the housing, and wherein the second case includes a second horizontal protrusion protruding from the inner surface of the second case, penetrating the second slit, and contacting the second switch when the second case is coupled to the housing.

19. The blower of claim 16, wherein the at least one switch includes a top switch that is deactivated when the filter is removed from the supporter tray.

20. The blower of claim 19, wherein the housing includes a groove which is formed on the one surface of the housing and having an opening, wherein the supporter tray is coupled to the groove and covers the opening, wherein the top switch is positioned opposite to the supporter tray with respect to the groove and is coupled to the groove, and wherein the supporter tray includes a vertical protrusion protruding from the supporter tray and penetrating the opening of the groove and contacting the top switch.

* * * * *